US006703344B2

(12) United States Patent
Ueki et al.

(10) Patent No.: US 6,703,344 B2
(45) Date of Patent: Mar. 9, 2004

(54) THERMAL RECORDING MATERIAL

(75) Inventors: Shiki Ueki, Shizuoka-ken (JP); Kazumori Minami, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 102 days.

(21) Appl. No.: 10/173,566

(22) Filed: Jun. 18, 2002

(65) Prior Publication Data

US 2003/0013608 A1 Jan. 16, 2003

(30) Foreign Application Priority Data

Jun. 18, 2001 (JP) ..... 2001-183893

(51) Int. Cl.[7] ..... B41M 5/30
(52) U.S. Cl. ..... 503/215; 503/226
(58) Field of Search ..... 503/215, 226

(56) References Cited

U.S. PATENT DOCUMENTS 5,492,789 A * 2/1996 Igarashi et al. ..... 430/138

FOREIGN PATENT DOCUMENTS

JP 2000-289337 10/2000

* cited by examiner

*Primary Examiner*—B. Hamilton Hess
(74) *Attorney, Agent, or Firm*—Sughrue Mion, PLLC

(57) ABSTRACT

The invention provides a thermal recording material comprising a support and at least one thermal recording layer disposed on the support, wherein the layer comprises at least one electron-accepting compound, and microcapsules, which encapsulate an electron-donating dye precurser and are formed using a compound represented by the following general formula (I) and a compound represented by the following general formula Formula (II):

Formula (I)

Formula (II)

wherein each of $R^1$ and $R^2$ represents an alkyl group; n is an integer selected from 0 to 3; and M represents Na, Mg, K or Ca.

19 Claims, No Drawings

THERMAL RECORDING MATERIAL

BACKGROUND OF THE INVENTION

1. Field of the Invention

The present invention relates to a thermal recording material, more precisely to a thermal recording material having good lightfastness and in particular to a thermal recording material having the advantages of good lightfastness and image fixation.

2. Description of the Related Art

Relatively inexpensive and capable of being processed in simple and reliable recording appliances not requiring maintenance, thermal recording materials for forming an image upon being provided with a heat by a thermal head, and the like are widely used in the art. Heretofore, there has been a high demand for high-performance thermal recording materials,for example, with improved high image quality or storage stability and the like. Thus, research relating to color density, image quality, storability, and the like has been performed.

Various types of thermal recording materials have been heretofore known, including, for example, those in which electron-donating leuco-dyes and electron-accepting compounds in which they are reacted to form colors, and those in which diazo compounds such as diazonium salts and couplers in which they are reacted to form colors.

The recent development in the art toward full-color thermal recording materials is noticeable. In general, full-color thermal recording materials have a laminate structure of yellow, magentaand cyan-coloring layers, in which the respective layers are thermally colored to form full-color images.

One example of such full-color thermal recording materials has a laminate structure of color-forming layers (thermal recording layers) comprising an electron-donating leuco-dye and an electron-accepting compound and color-forming layers comprising a diazo compound and a coupler, in which yellow, magenta and cyan color-forming layers are laminated in that order from its top.

One method of improving the storability and the image stability against light and heat of thermal recording materials is to encapsulate the electron-donating leuco-dyes and the diazo compounds in microcapsules. According to this method, the electron-donating leuco-dyes and the diazo compounds in thermal recording materials are isolated from water and bases that may promote their decomposition, and, as a result, the shelf life of the thermal recording materials is prolonged (Tomomasa Usami, et al., "*The Journal of the Electrophotography Society of Japan*", Vol. 26, No. 2, 1987, pp. 115–125).

In heat-responsive microcapsules, a type of microcapsules in which the glass transition point of the capsule wall is slightly higher than room temperature, the capsule wall is substance-impervious at room temperature but is substance-pervious at a temperature not lower than its glass transition point. Accordingly, when electron-donating leuco-dyes or diazo compounds are encapsulated with this capsule wall and electron-accepting compounds, couplers or bases are outside the microcapsules in the thermal recording material, then the encapsulated electron-donating leuco-dyes or diazo compounds can be kept stable for a long time and a color image can be readily formed by heating the material. In addition, the color image thus formed on the material can be readily fixed thereon through exposure to light (photofixation).

One general method of encapsulating a core substance of electron-donating dye precursors or diazo compounds into microcapsules comprises dissolving the core substance in a hydrophobic solvent (oily phase), followed by emulsifying and dispersing this mixture in an aqueous solution having a water-soluble polymer dissolved therein (aqueous phase) using a homogenizer or the like, with a monomer or a prepolymer, which will be the microcapsule wall, being added to one or both of the oily phase and the aqueous phase, to thereby polymerize the monomer or the prepolymer in the interface between the oily phase and the aqueous phase or precipitate the polymer to form a wall of the polymer compound. The method is described in detail, for example, in "*Microcapsules*" (by Tomoji Kondo, Nikkan Kogyo Shinbun Publishing, 1970); and "*Microcapsules*" (by Tamotsu Kondo, et al., Sankyo Publishing, 1977).

However, the above method of microcapsule formation is problematic in that the aqueous solution used forms a lot of bubbles. The bubbles often enter exhaust dusts and therefore lower the production efficiency, and also lower the properties such as the stability of the photographic materials that contain the microcapsules formed according to the method. Therefore, a surfactant that serves as a defoaming agent is generally added to the system of forming microcapsules according to the method. One typical example of the surfactant is sodium dodecylbenzenesulfonate. However, this is still unsatisfactory for completely preventing the generation of bubbles in forming microcapsules when the conditions of this method.

The sensitivity to heat of the microcapsules mentioned above is one important factor thereof. Therefore, if the sensitivity to heat of the microcapsules in one layer of a thermal photographic material is not stable, the quality of the photographic material decreases.

Moreover, when a full color thermal recording material, which is formed by stacking multiple thermal recording layers, uses highly sensitive microcapsules, a problem in that the thermal recording layers comprising microcapsules may generate colors by heat, which is added to cause a color forming reaction in the upper layers. This can cause a mixing of colors and an inferior thermal differation. Thus, when thermal recording layers are superimposed, it is preferable to use microcapsules having low heat sensitivity in the lower layers by the support.

For controlling the sensitivity of microcapsules, the reaction temperature in forming the microcapsules is particularly important. In addition, for satisfactorily preventing the generation of bubbles in microcapsule formation, the surfactant alone is unsatisfactory. Therefore, the reaction condition including the reaction temperature in microcapsule formation must be suitably controlled. However, it is difficult to stably form microcapsules of low sensitivity under the reaction conditions which prevent bubbles from being formed, and it has heretofore been difficult to produce full-color thermal recording materials of good thermal differentiation.

SUMMARY OF THE INVENTION

The present invention is to solve the problems in the prior art noted above, and its object is to provide a thermal recording material having the advantages of superior production suitability, production stability and thermal differentiation.

The means of the invention for solving the problems as above are mentioned below.

Specifically, the invention provides a thermal recording material comprising a support and at least one thermal recording layer disposed on the support, wherein the layer comprises at least one electron-accepting compound, and microcapsules, which encapsulate an electron-donating dye precurser and are formed using a compound represented by the following general formula (I) and a compound represented by the following general formula (II):

Formula (I)

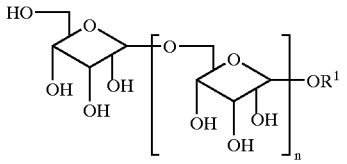

Formula (II)

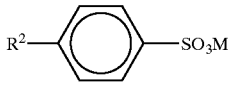

wherein each of $R^1$ and $R^2$ represents an alkyl group; n is an integer selected from 0 to 3; and M represents Na, Mg, K or Ca.

The invention also provides a thermal recording material comprising a support and at least one thermal recording layer disposed on the support, wherein the layer comprises at least microcapsules, which encapsulate a diazo compound, and a coupler, for reacting with the diazo compound to produce a color, which microcapsules are formed using a compound represented by the following general formula (I) and a compound represented by the following general formula (II):

Formula (I)

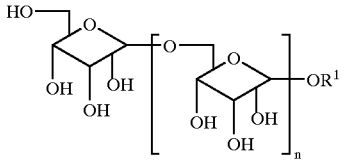

Formula (II)

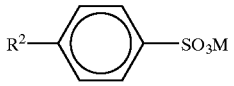

wherein each of $R^1$ and $R^2$ represents an alkyl group; n is an integer selected from 0 to 3; and M represents Na, Mg, K or Ca.

Moreover, the present invention provides the thermal recording material comprising a support and at least one thermal recording layer disposed on the support, the layer including at least an electron-accepting compound, microcapsules, which encapsulate an electron-donating dye precurser, microcapsules, which encapsulate a diazo compound, and a coupler, for reacting with the diazo compound to produce a color.

In the thermal recording material of the invention, the color density of the microcapsules at a recording energy of 100 mJ/mm$^2$ is at most 0.20.

DETAILED DESCRIPTION OF THE INVENTION

The thermal recording material of the invention is described in detail hereinunder.

Thermal Recording Material:

A thermal recording material of the present invention comprises a support and at least one thermal recording layer disposed on the support, the layer including at least an electron-accepting compound, and microcapsules, which encapsulate an electron-donating dye precursor, and are formed using a compound represented by the following general formula (I) (hereinafter, this may be referred to as a "surfactant (I)") and a compound represented by the following general formula (II) (hereinafter, this may be referred to as a "surfactant (II)").

In another aspect, the thermal recording material of the invention comprises, on a support, at least microcapsules, which encapsulate a diazo compound, and a coupler, for reacting with the diazo compound to produce a color, which microcapsules are formed using a compound represented by the following general formula (I) and a compound represented by the following general formula (II):

Formula (I)

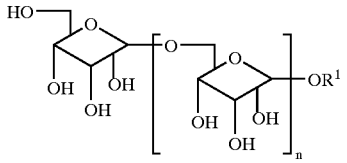

wherein $R^1$ represents an alkyl group, and n is from 0 to 3.

Formula (II)

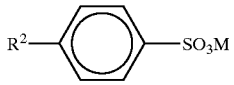

wherein each of $R^1$ and $R^2$ represents an alkyl group; n is an integer selected from 0 to 3; and M represents Na, Mg, K or Ca.

When forming the microcapsules that encapsulate the electron-donating dye precursor or the diazo compound (both of these will be referred to hereinafter as a "color-forming component") to be in the thermal recording material of the invention, the surfactants (I) and (II) can be used together to satisfactorily prevent a generation of bubbles in the microcapsule formation. Accordingly, the thermal recording material of the invention has excellent production suitability and performance, such as stability.

To stably form microcapsules of low sensitivity, some amount of heating is necessary. In the invention, it is possible to prevent bubbles from being formed in the microcapsule formation even at high temperatures since the surfactants (I) and (II) are used together therein, and thus microcapsules of low sensitivity can be stably formed.

The thermal recording material of the invention includes at least a thermal recording layer on a support, and the thermal recording layer may have a single-layered or multi-layered structure. If desired, the material may have other layers, such as light-transmittance controlling layer and a protective layer in accordance with necessity.

Thermal-Recording Layer:

The thermal recording layer in the invention includes microcapsules, which encapsulate in a color-forming component and are formed using the surfactants (I) and (II).

Surfactants:

The surfactant (I) is a compound of the following general formula (I):

Formula (I)

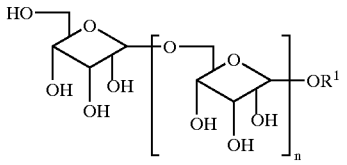

wherein $R^1$ represents an alkyl group. The alkyl group preferably has from 4 to 12 carbon atoms, and more preferably from 6 to 10 carbon atoms.

Specifically, examples of the alkyl group include t-octyl groups, n-octyl groups, n-hexyl groups, t-hexyl groups and n-dodecyl groups. Of those, t-octyl groups and n-octyl groups are preferable, and n-octyl groups are more preferable.

In formula (I), n is an integer selected from 0 to 3. In general, the surfactant (I) for use in the invention is amixture of compounds of formula (I) where n is an integer selected from 0 to 3, however, the range of n is not specifically defined.

An example of the surfactant (I) is mentioned below. However, the present invention is not limited to this example.

(I)-1

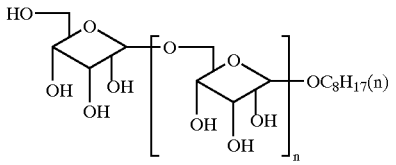

n = 0 ~ 3

The surf actant (II) for use in the invention is a compound of the following general formula (II):

Formula (II)

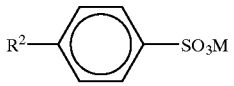

wherein $R^2$ represents an alkyl group. The alkyl group preferably has from 8 to 16 carbon atoms, more preferably from 10 to 14 carbon atoms. The alkyl group may be substituted.

Specifically, examples of the alkyl group includes n-octyl groups, t-octyl groups and n-dodecyl groups. Of those, n-dodecyl groups and t-dodecyl groups are preferable, and n-dodecyl groups are more preferable.

In formula (II), M represents Na, Ca, Mg or K, and is preferably Na.

Examples of the surfactant (II) are mentioned below. However, the invention is not limited to these examples.

(II)-1

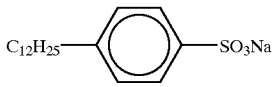

-continued (II)-2

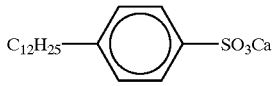

Method of Microcapsule Formation:

In the invention, at least an electron-donating dye precursor or a diazo compound is encapsulated in microcapsules.

For encapsulating the color-forming component in microcapsules, any known method may be used. For example, one preferable method of microcapsule formation is interfacial polymerization, which is performed as follows: An electron-donating dye precursor (or diazonium salt compound), which is a color-forming component, is dissolved or dispersed in a slightly water-soluble or water-insoluble organic solvent to prepare an oily phase, this is mixed with an aqueous phase having a water-soluble polymer dissolved therein, and the surfactants (I) and (II) are added to the resulting mixture, which is then emulsified and dispersed by a homogenizer or the like, and heated to cause interfacial polymerizing reaction, which forms a microcapsule wall of the polymer substance at the surface of oil drops. According to this method, microcapsules having a uniform size can be formed within a short period of time, and the recording material containing them has good storability.

In the method of microcapsule formation, the reaction temperature is preferably from 20 to 70° C. and, more preferably from 40 to 70° C. To stably form microcapsules of low sensitivity, the reaction temperature is preferably falls from 60 to 70° C. and, more preferably from 65 to 70° C. If the surfactants (I) and (II) are combined, themethodhas sufficient anti-foamability, even at a high reaction temperature of from 65 to 70° C., and microcapsules of low sensitivity can be stably formed. Here, "microcapsules of low sensitivity" indicates microcapsules that require high energy (high temperature) to form a color, or in other words, microcapsules, which do not form a color until they are heated to a sufficiently high temperature.

In the present invention, the surfactants are generally dissolved in water. The molar ratio of the surfactant (I) [x] to the surfactant (II) [y], x/y is preferably from 8/2 to 2/8, more preferably from 6/2 to 2/6, and is even more preferably 2/1. When the molar ratio falls is from 8/2 to 2/8, the surfactant mixture prevents bubbles from being formed, from accumulating excessively in the reaction tank, and can perform a sufficient defoaming effect.

The surfactants (I) and (II) may be combined with any other known surfactant, as long asthis does not interfere with the effect of the present invention. Examples of the known surfactant include sodium methylnaphthalenesulfonates and 2-ethylhexyl sulfosuccinates.

When the surfactants (I) and (II) are combined with any other known surfactant, the surfactants (I) and (II) preferably comprise at least 50% by weight, more preferably at least 80% by weight of the total amount of the surfactants used.

Examples of the organic solvent include low-boiling-point auxiliary solvents such as acetates, methylene chlorides and cyclohexanones, and/or phosphates, phthalates, acrylates, methacrylates, other carboxylates, aliphatic acid amides, alkylated biphenyls, alkylated terphenyls, alkylated naphthalenes, diarylethanes, chloroparaffins, alcohol solvents, phenol solvents, ether solvents, mono-olefin solvents, and epoxy solvents.

Examples of the high-boiling-point organic solvents are tricresyl phosphate, trioctyl phosphate, octyldiphenyl phosphate, tricyclohexyl phosphate, dibutyl phthalate, dioctylphthalate, dilaurylphthalate, dicyclohexylphthalate, butyl esters of olefinic acids, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chloroparaffins, diisopropylnaphthalene, 1,1'-ditolylethane, monoisopropylbiphenyl, diisopropylbiphenyl, 2,4-di-tert-amylphenol, N,N-dibutyl-2-butoxy-5-tert-octylaniline, 2-ethylhexyl hydroxybenzoate, polyethylene glycol.

Of those, alcohol solvents, phosphate solvents, carboxylate solvents, alkylated biphenyls, alkylated terphenyls, alkylated naphthalenes, and diarylethanes are especially preferable.

In addition, carbonization inhibitors such as hindered phenols and hindered amines may be added to the high-boiling-point solvents. The high-boiling-point solvents preferably have unsaturated fatty acids, for example, α-methylstyrene dimers. A commercial product of a-methylstyrene dimers is, for example, MSD100 (trade name, producted by Mitsui Toatsu Chemical Co. Ltd.).

An example of the water-soluble polymer is polyvinyl alcohol, for example, polyvinyl alcohol, silanol-modified polyvinyl alcohol, carboxy-modified polyvinyl alcohol, amino-modified polyvinyl alcohol, itaconic acid-modified polyvinyl alcohol, styrene-maleic anhydride copolymer, butadiene-maleic anhydride copolymer, ethylene-maleic anhydride copolymer, isobutylene-maleic anhydride copolymer, polyacrylamide, polystyrenesulfonic acid, polyvinylpyrrolidone, ethylene-acrylic acid copolymer, and gelatin. Among these, carboxy-modified polyvinyl alcohol is preferable.

The water-soluble polymer may be combined with a hydrophobic polymer emulsion or latex. Examples of the emulsions latexes include styrene-butadiene copolymers, carboxy-modified styrene-butadiene copolymers and acrylonitrile-butadiene copolymers.

Examples of the polymer substance, which forms the microcapsule walls include polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol. Among these examples, polyurethane-polyurea resins are particularly preferable.

For example, when a polyurethane-polyurea resin is used for the microcapsule wall material, microcapsule walls are produced as follows: a microcapsule wall precursor such as a polyisocyanate is mixed with an oily medium (oily phase), which will be a core substance to be encapsulated. Furthermore, a second substance (e.g., polyols, polyamines) that reacts with the microcapsule wall precursor to form a capsule wall is mixed in an aqueous solution of a water-soluble polymer (aqueous phase). The oily phase is emulsified and dispersed in the aqueous phase and then heated to cause interfacial polymerization to form a microcapsule wall around every oil drop.

Examples of the polyisocyanate compound are given below, however, the invention is not limited to these examples: diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate; triisocyanates such as 4,4',4"-trihenylmethane triisocyanate, toluene-2,4,6-triisocyanate; tetraisocyanates such as 4,4'-dimethylphenylmethane-2,2',5,5'-tetraisocyanate; and isocyanate prepolymers such as hexamethylene diisocyanate-trimethylolpropane adduct, 2,4-tolylene diisocyanate-trimethylolpropane adduct, xylylene diisocyanate-trimethylolpropane adduct, tolylene diisocyanate-hexanetriol adduct.

In accordance with necessity, two or more of these examples may be used in combination. Among those examples, those having at least three isocyanate groups in the molecule are particularly preferable.

In the method of microcapsule formation, the organic solvent in which the microcapsule wall precursor and the second substance, with which it reacts, as well as other components such as couplers (and electron-accepting compound), organic bases and sensitizers are dissolved have the same meaning as the organic solvent mentioned hereinabove.

The size of the microcapsules is preferably from 0.1 to 2.0 μm, and more preferably from 0.2 to 1.5 μm.

Electron-Donating Dye Precursor:

Examples of the electron-donating dye precursor include triarylmethane compounds, diphenylmethane compounds, thiazine compounds, xanthene compounds, and spiropyran compounds. Of those, triarylmethane compounds and xanthene compounds are preferable, as they form color images of high density.

Specifically, examples of the compounds for the dye precursor include 3,3-bis(p-dimethylaminophenyl)-6-dimethylaminophthalide (crystal violet lactone), 3,3-bis(p-dimethylamino)phthalide, 3-(p-dimethylaminophenyl)-3-(1,3-dimethylindol-3-yl)-phthalide, 3-(p-dimethylaminophenyl)-3-(2-methylindol-3-yl)phthalide, 3-(o-methyl-p-diethylaminophenyl)-3-(2-methylindol-3-yl)-phthalide, 4,4'-bis(dimethylamino)benzhydrin benzyl ether, N-halophenyl leucoauramine, N-2,4,5-trichlorophenyl leucoauramine, rhodamine-B-anilinolactam, rhodamine(p-nitroanilino)lactam, rhodamine-B-(p-chloroanilino)lactam, 2-benzylamino-6-diehtylaminofluorane, 2-anilino-6-diethylaminofluorane, 2-anilino-3-methyl-6-diethylaminofluorane, 3-anilino-3-methyl-6-cyclohexyldethylaminofluorane, 2-anilino-3-methyl-6-isoamylethylaminofluorane, 2-(o-chloroanilino)-6-diethylaminofluorane, 2-octylamino-6-diethylaminofluorane, 2-ethoxyethylamino-3-chloro-3-diethylaminofluorane, 2-anilino-3-chloro-6-diethylaminofluorane, benzoyl leucomethylene blue, p-nitrobenzyl leucomethylene blue, 3-methylspyrodinaphthopyran, 3-ethylspyrodinaphthopyran, 3,3'-dichlorospyrodinaphthopyran, 3-benzylspyrodinaphthopyran, 3-propylspyrodibenzopyran.

The coating amount of the electron-donating dye precursor is preferably from 0.1 to 1 g/m$^2$ in the thermal recording layer, for the same reason as that for the diazonium salt compound mentioned above.

Electron-Accepting Compound:

Examples of the electron-accepting compound include phenol derivatives, salicylic acid derivatives, and hydroxybenzoates. Among these examples, bisphenols and hydroxybenzoates are particularly preferable. Specifically, they include the following:

2,2-Bis(p-hydroxyphenyl)propane (bisphenol A), 4,4'-(p-phenylenediisopropylidene)diphenol (bisphenol P), 2,2-bis(p-hydroxyphenyl)pentane, 2,2-bis(p-hydroxyphenyl)ethane, 2,2-bis(p-hydroxyphenyl)butane, 2,2-bis(4'hydroxy- 3',5'-dichlorophenyl)propane, 1,1-(p-hydroxyphenyl) cyclohexane, 1,1-(p-hydroxyphenyl)propane, 1,1-(p-hydroxyphenyl)pentane, 1,1-(p-hydroxyphenyl)-2-ethylhexane, 3,5-di(α-methylbenzyl) salicylic acid and polyvalent metal salts thereof, 3,5-di(tert-butyl)salicylic acid and its polyvalent metal salts, 3-α,α-dimethylbenzylsalicylic acid and polyvalent metal salts thereof, butyl p-hydroxybenzoate, benzyl p-hydroxybenzoate, 2-ethylhexyl p-hydroxybenzoate, p-phenylphenol, and p-cumylphenol.

The electron-accepting compound content of the thermal recoding layer is preferably from 0.1 to 30 parts by weight relative to 1 part by weight of the electron-donating dye precursor.

Diazo Compound:

The diazo compound to be encapsulated into microcapsules includes, for example, diazonium salt compounds of the following formula (1):

$$Ar—N_2^+X^- \quad (1)$$

wherein Ar represents an aromatic group, and $X^-$ represents an acid anion.

The diazonium salt couples with a coupler, which will be described below, to form a color when heated, or decomposes when exposed to light. Depending on the site and the type of the substituent in the Ar moiety therein, the maximum absorption wavelength of the diazonium salt compound can be controlled.

Examples of the diazonium group to form the salts are 4-(p-tolylthio)-2,5-dibutoxybenzenediazonium, 4-(4-chlorophenylthio)-2,5-dibutoxybenzenediazonium, 4-(N,N-dimethylamino)benzenediazonium, 4-(N,N-diethylamino) benzenediazonium, 4-(N,N-dipropylamino) benzenediazonium, 4-(N-methyl-N-benzylamino) benzenediazonium, 4-(N,N-dibenzylamino) benzenediazonium, 4-(N-ethyl-N-hydroxyethylamino) benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybenzenediazonium, 4-anilinobenzenediazonium, 4-[N-(4-methoxybenzoyl)amino]-2,5-diethoxybenzenediazonium, 4-pyrrolidino-3-ethylbenzenediazonium, 4-[N-(1-methyl-2-(4-methoxyphenoxy)ethyl)-N-hexylamino]-2-hexyloxybenzenediazonium, 4-[N-(2-(4-methoxyphenoxy) ethyl)-N-hexylamino]-2-hexyloxybenzenediazonium, 2-(1-ethylpropyloxy)-4-[di-(di-n-butylaminocarbonylmethyl) amino]benzenediazonium, 2-benzylsulfonyl-4-[N-methyl-N-(2-octanoyloxyethyl)]-aminobenzenediazonium.

The maximum absorption wavelength λmax of the diazonium salt compound is preferably no more than 450 nm, and more preferably from 290 to 440 nm. If λmax of the compound is longer than 450 nm, the storability of the thermal recording material containing the compound will be poor; but if shorter than the range mentioned above, the image fixation and the image storage stability of the recording material will be reduced and the color of the images formed on the material will inferior, depending on the combination of the compound with a coupler to be combined with it. The coupler will be described hereinunder.

The diazonium salt compound preferably has at least 12 carbon atoms, a solubility in water is at most 1% and in ethyl acetate of at least 5%.

These diazonium salt compounds may be used either singly or in combinations of two or more, depending on the object of the compounds for color control.

Of the diazonium salts compounds mentioned above, those of the following structural formulae (1) to (3) are more preferable in view of their effect to form dyes of better color hue and their effect to ensure better image fixation and image storage stability.

Structural Formula (1)

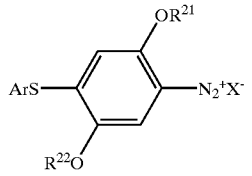

Structural Formula (2)

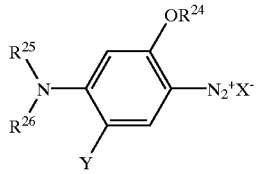

Structural Formula (3)

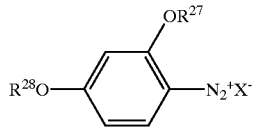

In the structural formula (1), Ar represents a substituted or unsubstituted aryl group.

Examples of the substituents for the aryl group include alkyl groups, alkoxy groups, alkylthio groups, aryl groups, aryloxy groups, arylthio groups, acyl groups, alkoxycarbonyl groups, carbamoyl groups, carbamido groups, sulfonyl groups, sulfamoyl groups, sulfonamido groups, ureido groups, halogen atoms, amino groups, and heterocyclic groups. These substituents may be further substituted.

The aryl group for Ar preferably has from 6 to 30 carbon atoms, for example, groups of phenyl, 2-methylphenyl, 2-chlorophenyl, 2-methoxyphenyl, 2-butoxyphenyl, 2-(2-ethylhexyloxy)phenyl, 2-octyloxyphenyl, 3-(2,4-di-t-pentylphenoxyethoxy)phenyl, 4-chlorophenyl, 2,5-dichlorophenyl, 2,4,6-trimethylphenyl, 3-chlorophenyl, 3-methylphenyl, 3-methoxyphenyl, 3-butoxyphenyl, 3-cyanophenyl, 3-(2-ethylhexyloxy)phenyl, 3,4-dichlorophenyl, 3,5-dichlorophenyl, 3,4-dimethoxyphenyl, 3-(dibutylaminocarbonylmethoxy)phenyl, 4-cyanophenyl, 4-methylphenyl, 4-methoxyphenyl, 4-butoxyphenyl, 4-(2-ethylhexyloxy)phenyl, 4-benzylphenyl, 4-aminosulfonylphenyl, 4-N,N-dibutylaminosulfonylphenyl, 4-ethoxycabonylphenyl, 4-(2-ethylhexylcarbonyl)phenyl, 4-fluorophenyl, 3-acetylphenyl, 2-acetylaminophenyl, 4-(4-chlorophenylthio)phenyl, 4-(4-methylphenyl)thio-2,5-butoxyphenyl, and 4-(N-benzyl-N-methylamino)-2-dodecyloxycarbonylphenyl. However, the invention is not limited to these groups.

These groups may be further substituted with any of alkyloxy groups, alkylthio group, substituted phenyl groups, cyano groups, substituted amino groups, halogen atoms, and heterocyclic groups.

In the structural formula (1), $R^{21}$ and $R^{22}$ each independently represent a substituted or unsubstituted alkyl group, or a substituted or unsubstituted aryl group. $R^{21}$ and $R^{22}$ may be the same or different.

In case where the group for $R^{21}$ and $R^{22}$ is substituted, examples of the substituent for the group include an alkoxy group, an alkoxycarbonyl group, an alkylsulfonyl group, a substituted amino group, a substituted amido group, an aryl group, and an aryloxy group. However, the invention is not limited to those examples.

The alkyl group for $R^{21}$ and $R^{22}$ preferably has from 1 to 18 carbon atoms, examples include, groups of methyl, trifluoromethyl, ethyl, propyl, isopropyl, butyl, sec-butyl, t-butyl, pentyl, isopentyl, cyclopentyl, hexyl, cyclohexyl, octyl, t-octyl, 2-ethylhexyl, nonyl, octadecyl, benzyl, 4-methoxybenzyl, triphenylmethyl, ethoxycarbonylmethyl, butoxycarbonylmethyl, 2-ethylhexyloxycarbonylmethyl, 2',4'-diisopentylphenyloxymethyl, 2',4'-di-t-butylphenyloxymethyl, dibenzylaminocarbonylmethyl, 2,4-di-t-amylphenyloxypropyl, ethoxycarbonylpropyl, 1-(2',4'-di-t-amylphenyloxy)propyl, acetylaminoethyl, 2-(N,N-dimethylamino)ethyl, 2-(N,N-diethylamino)propyl, methanesulfonylaminopropyl, acetylaminoethyl, 2-(N,N-dimethylamino) ethyl, and 2-(N,N-diethylamino)propyl.

The aryl group for $R^{21}$ and $R^{22}$ preferably has from 6 to 30 carbon atoms, examples include, groups of phenyl, 2-methylphenyl, 2-chlorophenyl, 2-methoxyphenyl, 2-butoxyphenyl, 2-(2-ethylhexyloxy)phenyl, 2-octyloxyphenyl, 3-(2,4-di-t-pentylphenoxyethoxy)phenyl, 4-chlorophenyl, 2,5-dichlorophenyl, 2,4,6-trimethylphenyl, 3-chlorophenyl, 3-methylphenyl, 3-methoxyphenyl, 3-butoxyphenyl, 3-cyanophenyl, 3-(2-ehtylhexyloxy) phenyl, 3,4-dichlorophenyl, 3,5-dichlorophenyl, 3,4-dimethoxyphenyl, 3-(dibutylaminocarbonylmethoxy) phenyl, 4-cyanophenyl, 4-mehtylphenyl, 4-methoxyphenyl, 4-butoxyphenyl, 4-(2-ethylhexyloxy)phenyl, 4-benzylphenyl, 4-aminosulfonylphenyl, 4-N,N-dibutylaminosulfonylphenyl, 4-ethoxycarbonylphenyl, 4-(2-ethylhexylcarbonyl)phenyl, 4-fluorophenyl, 3-acetylphenyl, 2-acetylaminophenyl, 4-(4-chlorophenylthio)phenyl, 4-(4-methylphenyl)thio-2,5-butoxyphenyl, and 4-(N-benzyl-N-methylamino)-2-dodecyloxycarbonylphenyl. However, the invention is not limited to those examples.

These groups may be further substituted with alkyloxy groups, alkylthio groups, substituted phenyl groups, cyano groups, substituted amino groups, halogen atoms, and heterocyclic groups.

In the structural formula (2), each of $R^{24}$, $R^{25}$ and $R^{26}$ each independently represents a substituted or unsubstituted alkyl group, or a substituted or unsubstituted aryl group, and $R^{24}$, $R^{25}$ and $R^{26}$ may be the same or different.

Examples of the substituent for the substituted groups include an alkyl group, an alkoxy group, an alkylthio group, an aryl group, an aryloxy group, an arylthio group, an acyl group, an alkoxycarbonyl group, a carbamoyl group, a carbamido group, a sulfonyl group, a sulfamoyl group, a sulfonamido group, an ureido group, a halogen atom, an amino group, and a heterocyclic group.

The alkyl group for $R^{24}$, $R^{25}$ and $R^{26}$ preferably has from 1 to 18 carbon atoms, including, for example, the alkyl groups mentioned hereinabove for $R^{21}$ and $R^{22}$ in formula (1), and 1-methyl-2-(4-methoxyphenoxy)ethyl, di-n-butylaminocarbonylmethyl and di-n-octylaminocarbonylmethyl groups.

The aryl group for $R^{24}$, $R^{25}$ and $R^{26}$ has the same meaning as that for $R^{21}$ and $R^{22}$ in formula (1). However, the invention is not limited to these groups.

The groups may be further substituted with alkyloxy groups, alkylthio groups, substituted phenyl groups, cyano groups, substituted amino groups, halogen atoms, and heterocyclic groups.

In the structural formula (2), Y represents a hydrogen atom, or $OR^{23}$; and $R^{23}$ represents a substituted or unsubstituted alkyl group, or a substituted or unsubstituted aryl group.

Examples of the substituent for the substituted groups include an alkyl group, an alkoxy group, an alkylthio group, an aryl group, an aryloxy group, an arylthio group, an acyl group, an alkoxycarbonyl group, a carbamoyl group, a carbonamido group, a sulfonyl group, a sulfamoyl group, a sulfonamido group, an ureido group, ahalogen atom, an amino group, and a heterocyclic group.

Y is preferably a hydrogen atom or an alkyloxy group $OR^{23}$ in which $R^{23}$ is an alkyl group, in view of color control of the compound.

The alkyl group for $R^{23}$ has the same meaning as that for $R^{21}$ and $R^{22}$ in formula (1), however, the invention is not limited to this.

The aryl group for $R^{23}$ has the same meaning as that for $R^{21}$ and $R^{22}$ in formula (1), however, the invention is not limited to this. The aryl group may be substituted with any of alkyloxy groups, alkylthio groups, substituted phenyl groups, cyano groups, substituted amino groups, halogen atoms, and heterocyclic groups.

In the structural formula (3), each of $R^{27}$ and $R^{28}$ independently represents a substituted or unsubstituted alkyl group, or a substituted or unsubstituted aryl group, and $R^{27}$ and $R^{28}$ may be the same or different.

Examples of the substituent for the substituted groups include an alkyl group, an alkoxy group, an alkylthio group, an aryl group, an aryloxy group, an arylthio group, an acyl group, an alkoxycarbonyl group, a carbamoyl group, a carbamido group, a sulfonyl group, a sulfamoyl group, a sulfonamido group, an ureido group, a halogen atom, an amino group, and a heterocyclic group.

The alkyl group for $R^{27}$ and $R^{28}$ has the same meaning as that for $R^{21}$ and $R^{22}$ in formula (1). However, the invention is not limited to this.

The aryl group for $R^{27}$ and $R^{28}$ has the same meaning as that for $R^{21}$ and $R^{22}$ in formula (1). However, the invention is not limited to this. The aryl group may be substituted with any of alkyloxy groups, alkylthio groups, substituted phenyl groups, cyano groups, substituted amino groups, halogen atoms, and heterocyclic groups.

In the structural formulae (1) to (3), $X^-$ represents an acid anion. Examples of the acid for the anion include polyfluoroalkylcarboxylic acids having from 1 to 9 carbon atoms, polyfluoroalkylsulfonic acids having from 1 to 9 carbon atoms, boron tetrafluoride, tetraphenylboron, hexafluorophosphoric acid, aromatic carboxylic acids, and aromatic sulfonic acids. Of those, preferred are hexafluorophosphoric acids in view of the crystallinity of the compounds.

Examples of the diazonium salt compounds of the structural formulae (1) to (3) are given below. However, the invention is not limited to these formulae.

(2)-1

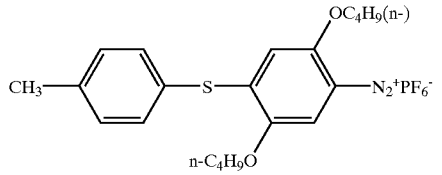

(2)-2

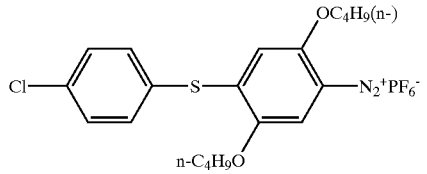

-continued (2)-3

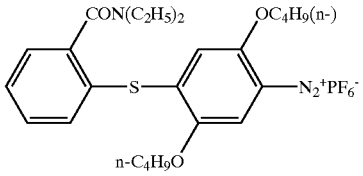

(2)-4

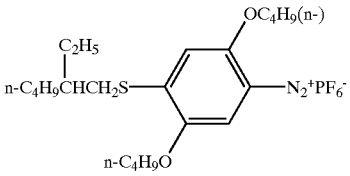

(3)-1

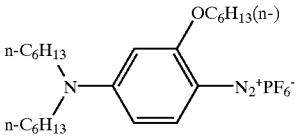

(3)-2

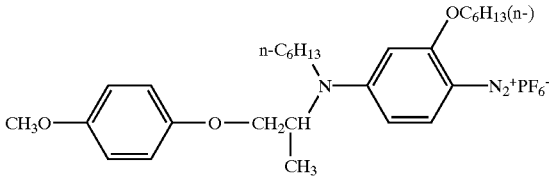

(3)-3

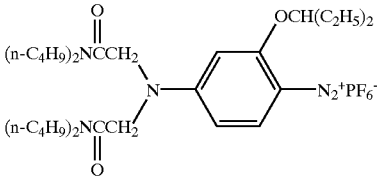

(3)-4

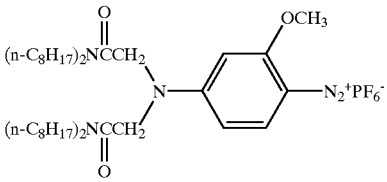

(3)-5

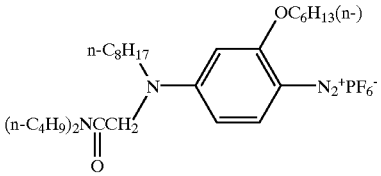

(3)-6

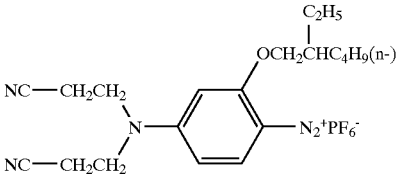

-continued (3)-7

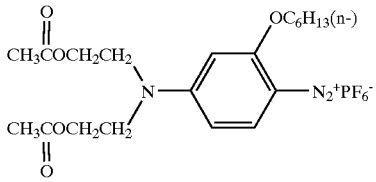

(3)-8

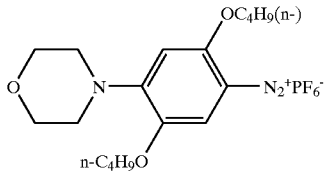

(3)-9

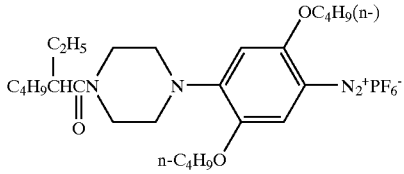

(3)-10

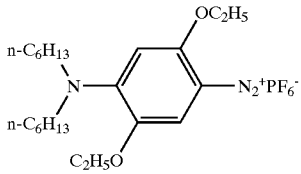

(4)-1

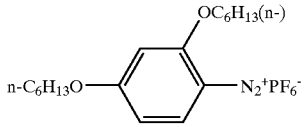

The diazonium salt compounds of the structural formulae (1) to (3) may be used herein either singly or in combinations of two or more. Further, the diazonium salt compounds of the structural formulae (1) to (3) may be combined with any other known diazonium salt compounds, depending on the objects such as color control and the like.

The coating amount of the diazonium salt compound is preferably from 0.05 to 2 g/m$^2$, and more preferably from 0.1 to 1 g/m$^2$ in the thermal recording layer. If the content of the compound in the layer is smaller than 0.05 g/m$^2$, the layer might not be able to obtain sufficient color density; but if larger than 2 g/m$^2$, the coatability of the coating liquid for the layer may become inferior.

Coupler:

The coupler that couples with the diazonium salt compound mentioned above to form a dye may be any and every one capable of coupling with the diazonium salt compound to form a dye in a basic and/or neutral atmosphere.

All 4-equivalent couplers that are used in silver halide photographic materials are usable in the invention, and may be selected for use herein depending on the object of the invention including the intended color of the images to be formed.

For example, active methylene compounds having a methylene group adjacent to the carbonyl group thereof, phenol derivatives and naphthol derivatives are usable for the couplers in the invention.

Among them, compounds of the following formula (2) and their tautomers are especially preferred for use herein.

$$E^1—CH_2-E^2 \quad (2)$$

wherein each of $E^1$ and $E^2$ independently represents an electron-attracting group, and may be the same or different.

The electron-attracting group is a substituent having a positive Hammett's value δ. Preferred examples thereof are acyl group including groups of acetyl, propionyl, pivaloyl, chloroacetyl, trichloroacetyl, trifluoroacetyl, 1-methylcyclopropylcarbonyl, 1-ethylcyclopropylcarbonyl, 1-benzylcyclopropylcarbonyl, benzoyl and 4-methoxybenzoyl, thenoyl groups; an alkoxycarbonyl group including groups of methoxycarbonyl, ethoxycarbonyl, 2-methoxyethoxycarbonyl and 4-methoxyphenoxycarbonyl groups; a carbamoyl group including carbamoyl, N,N-dimethylcarbamoyl, N,N-diethylcarbamoyl, N-phenylcarbamoyl, N-[2,4-bis(pentyloxy)phenyl]carbamoyl, N-[2,4-bis(octyloxy)phenyl]carbamoyl and morpholinocarbonyl groups; an alkylsulfonyl or arylsulfonyl group including groups of methanesulfonyl, benzenesulfonyl and toluenesulfonyl groups; a phosphono group such as a diethylphosphono group; a heterocyclic group including benzoxazol-2-yl, benzothiazol-2-yl, 3,4-dihydroquinazolin-4-on-2-yl and 3,4-dihydroquinazolin-4-sulfon-2-yl groups; a nitro group, an imino group, and a cyano group.

$E^1$ and $E^2$ may be bonded to each other to form a ring. The ring to be formed by $E^1$ and $E^2$ is preferably a 5-membered or 6-membered, carbon or hetero ring.

Examples of the couplers are resorcinol, phloroglucine, 2,3-dihydroxynaphthalene, 2,3-dihydroxynaphthalene-6-sodium sulfonate, 1-hydroxy-2-naphthoemorpholinopropylamide, 2-hydroxy-3-naphthalenesodium sulfonate, 2-hydroxy-3-naphthalenesulfonanilide, 2-hydroxy-3-naphthalenesulfonmorpholinopropylamide, 2-hydroxy-3-naphthalenesulfon-2-ethylhexyloxypropylamide, 2-hydroxy-3-naphthalenesulfon-2-ethylhexylamide, 5-acetamido-1-naphthol, 1-hydroxy-8-acetamidonaphthalene-3,6-sodium disulfonate, 1-hydroxy-8-acetamidonaphthalene-3,6-disulfodianilide, 1,5-dihydoxynaphthalene, 2-hydroxy-3-naphthoemorpholinopropylamide, 2-hydroxy-3-naphthoeoctylamide, 2-hydroxy-3-naphthoeanilide, 5,5-dimethyl-1,3-cyclohexadione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-mehtyl-5-pyrazolone, 1-(2,4,6-trichlorophenyl)-3-anilino-5-pyrazolone, 1-(2,4,6-trichlorophenyl)-3-benzamido-5-pyrazolone, 6-hydroxy-4-methyl-3-cyano-1-(2-ethylhexyl)-2-pyridone, 2,4-bis(benzoylacetamido)toluene, 1,3-bis(pivaloylacetamidomethyl)benzene, benzoylacetonitrile, thenoylacetonitrile, acetacetanilide, benzoylacetanilide, pivaloylacetanilide, 2-chloro-5-(N-n-butylsulfamoyl)-1-pivaloylacetamidobenzene, 1-(2-ethylhexyloxypropyl)-3-cyano-4-methyl-6-hydroxy-1,2-dihydropyridin-2-one, 1-(dodecyloxypropyl)-3-acetyl-4-methyl-6-hydroxy-1,2-dihydropyridin-2-one, and 1-(4-n-octyloxyphenyl)-3-tert-butyl-5-aminopyrazole.

The details of the couplers are described in JP-A Nos.4-201483, 7-223367, 7-223368, and7-323660, and in Japanese Patent Application Nos. 5-278608, 5-297024, 6-18669, 6-18670, 7-316280, 8-027095, 8-027096, 8-030799, 8-12610, 8-132394, 8-358755, 8-358756, and 9-069990.

Examples of the couplers of formula (2) are mentioned below, however, the invention is not limited to these examples.

B-1

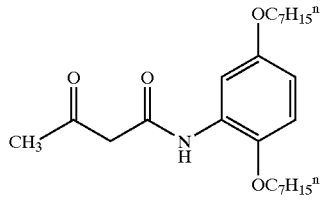

B-2

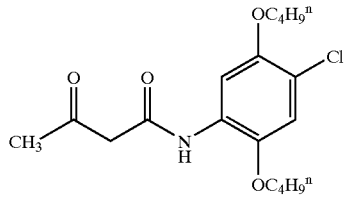

B-3

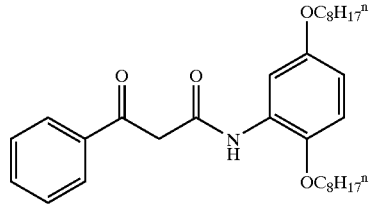

B-4

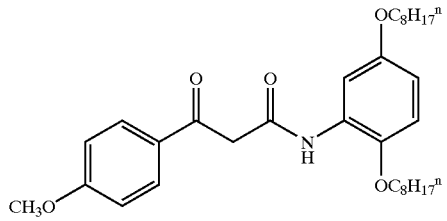

B-5

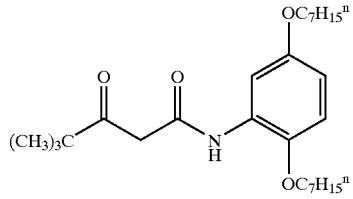

B-6

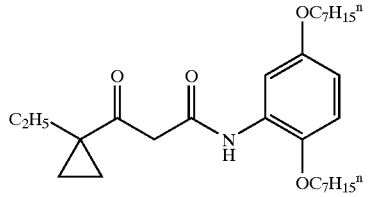

-continued
B-7
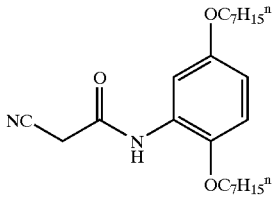
B-8
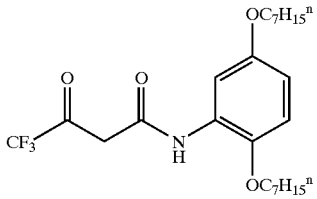
B-9
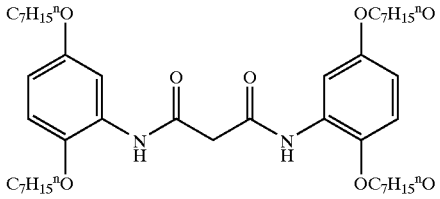
B-10
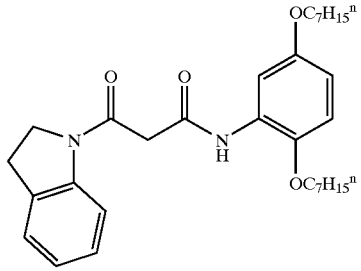
B-11
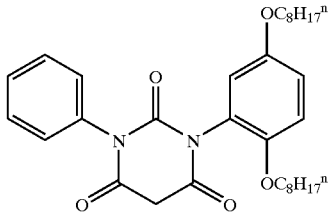
B-12
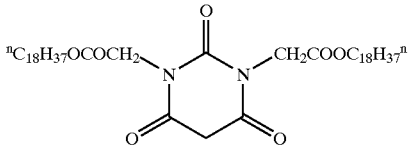
B-13
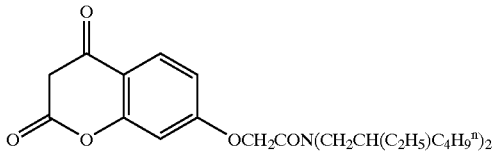
-continued
B-14
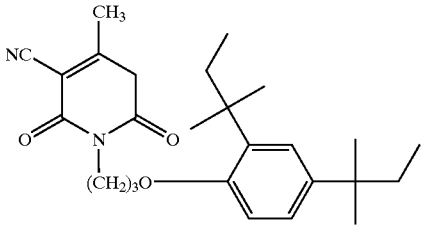
B-15
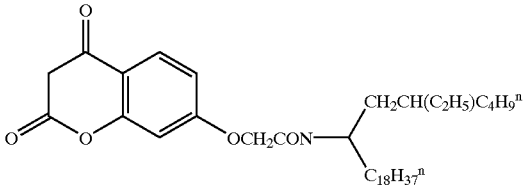
B-16
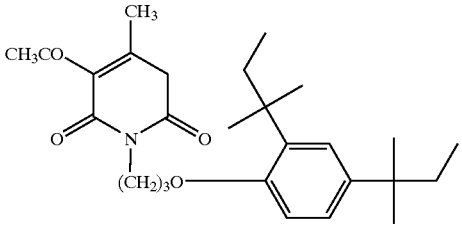
B-17
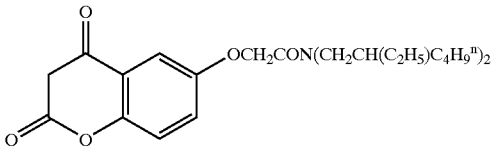
B-18
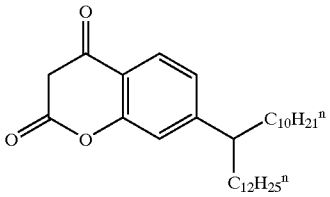
B-19
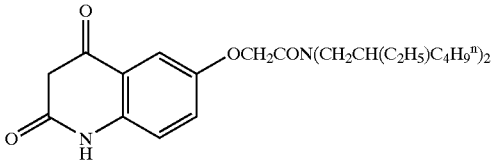
B-20
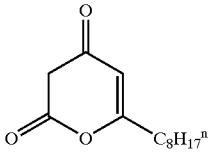
B-21
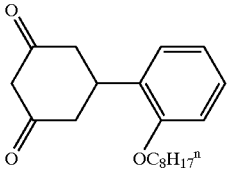

-continued

B-22

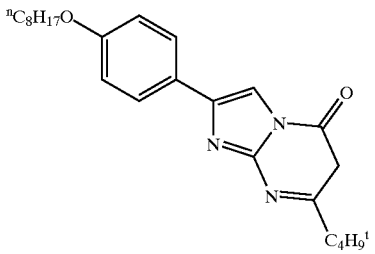

B-23

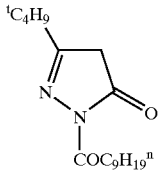

B-24

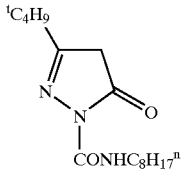

B-25

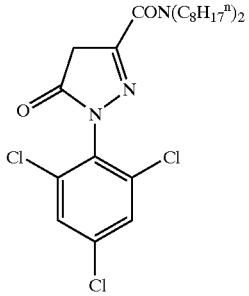

B-26

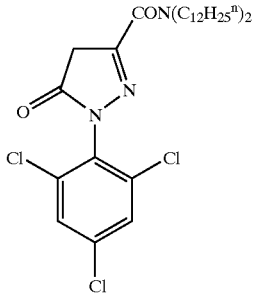

B-27

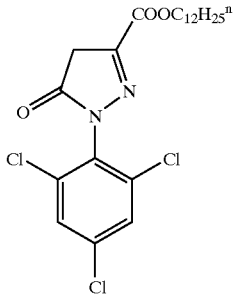

-continued

B-28

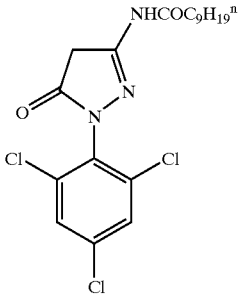

B-29

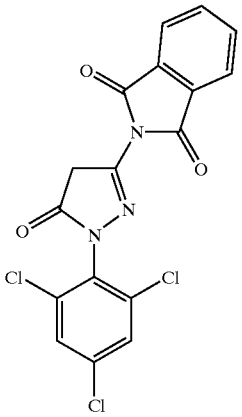

B-30

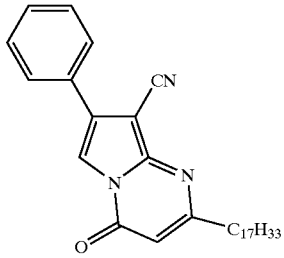

The coupler content of the thermal recording layer in the invention is preferably from 0.1 to 30 parts by weight relative to 1 part by weight of the diazonium salt compound in the layer.

Other Components:

Organic Base

An organic base is preferably added to the photosensitive thermal recording layer in the invention to promote the coupling reaction of the diazonium salt with the coupler in the layer.

The organic base is preferably in the layer along with the diazonium salt and the coupler, and the organic base may be in the layer singly or in combinations of two or more.

Examples of the organic base include nitrogen-containing compounds such as tertiary amines, piperidines, piperazines, amidines, formamidines, pyridines, guanidinesandmorpholines. In addition, organic bases described in JP-B 52-46806, JP-A Nos. 62-70082, 57-169745, 60-94381, 57-123086, 58-1347901, and 60-49991, JP-B Nos. 2-24916, and 2-28479, JP-A Nos. 60-165288, and 57-185430 are also usable herein.

Among these examples, piperazines such as N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis (3-phenylthio-2-hydoxypropyl)piperazine, N,N'-bis[3-(β-naphthoxy)-2-hydroxypropyl]piperazine, N-3-(β-naphthoxy)-2-hydroxypropyl-N'-methylpiperazine, 1,4-bis{[3-(N-methylpiperazino)-2-hydroxy]propyloxy}-benzene; morpholines such as N-[3-(βnaphthoxy)-2-hydroxy]propylmorpholine, 1,4-bis(3-morpholino-2-hydroxypropyloxy)benzene, 1,3-bis(3-morpholino-2-hydroxypropyloxy)benzene; piperidines such as N-(3-phenoxy-2-hydroxypropyl)piperidine, N-dodecylpiperidine; and guanidines such as triphenylguanidine, tricyclohexylguanidine, dicyclohexylphenylguanidine are particularly preferable.

When the organic base is included in the thermal recording layer, an amount thereof is preferably from 0.1 to 30 parts by weight relative to 1 part by weight of the diazonium salt compound therein.

Sensitizer

In addition to the organic base mentioned above, a sensitizer may be added to the thermal recording layer to promoting the color formation in the layer.

The sensitizer acts to increase the color density of the color images formed by heat, or to lower the minimum color-forming temperature of the thermal recording layer. Specifically, it lowers the melting point of the coupler, the organic base and the diazonium salt in the layer, or the softening point of the capsule wall of the microcapsules in the layer, thereby enhancing the reactivity of the diazonium salt, the organic base and the coupler.

Specifically, low-melting-point organic compounds having an aromatic group and a polar group to a suitable degree in the molecule are preferable as the sensitizer. Examples include benzyl p-benzyloxybenzoates, α-naphthyl benzyl ethers, β-naphthyl benzyl ethers, phenyl β-naphthoates, phenyl α-hydroxy-β-naphthoates, β-naphthol (p-chlorobenzyl) ethers, 1,4-butanediol phenyl ethers, 1,4-butanediol p-methylphenyl ethers, 1,4-butanediol p-ethylphenyl ethers, 1,4-butanediol m-methylphenyl ethers, 1-phenoxy-2-(p-tolyloxy)ethanes, 1-phenoxy-2-(p-ethylphenoxy)ethanes, 1-phenoxy-2-(p-chlorophenoxy)ethanes, and p-benzylbiphenyls.

Binder

The binder to be in the thermal recording layer may be any known water-soluble polymer compound or latex.

Examples of the water-soluble polymer compound include methyl cellulose, carboxymethyl cellulose, hydroxyethyl cellulose, hydroxypropyl cellulose, starch derivatives, casein, arabic gum, gelatin, ethylene-maleic anhydride copolymer, styrene-maleic anhydride copolymer, polyvinyl alcohol, epichlorohydrin-modified polyamide, isobutylene-maleinsalicylic anhydride copolymer, polyacrylic acid, polyacrylamide, and their modified derivatives; and the latex includes, for example, styrene-butadiene rubber latex, methyl acrylate-butadiene rubber latex, and polyvinyl acetate emulsion.

Antioxidant

It is also preferable to add known antioxidants such as those mentioned below to the thermal recording layer for improving the fastness to light and heat of the color images formed and for reducing the yellowness by light of the non-printed area (non-image area) of the recording material after image fixation thereon.

Examples of the antioxidants that are usable herein are described in EP-A Nos. 223739, 309401, 309402, 310551, 310552, and 459416, GP-A No. 3435443, JP-A Nos. 54-48535, 62-262047, 63-113536, 63-163351, 2-262654, 2-71262, 3-121449, 5-61166, and 5-119449, and USP Nos. 4,814,262, and 4,980,275.

In the present invention, the mode of using the couplers, the organic bases, the sensitizers and other components is not particularly limited. For example, these components may be solid (1) dispersed; (2) emulsified and dispersed; (3) polymer dispersed; (4) latex dispersed, or (5) encapsulated into microcapsules.

Constitution of Thermal Recording Material:

Concrete embodiments of the constitution of full-color thermal recording materials of the invention are described below.

The thermal recording material of the invention is a monochromatic thermal recording material having, on a support, one thermal recording layer specifically defined herein, or a full-color thermal recording material having a laminate layer structure of multiple thermal recording layers formed on a support in which at least one thermal recording layer of the present invention. In the full-color thermal recording material, it is desirable that at least one thermal recording layer is a photo-fixing recording layer that contains a diazonium salt compound and a coupler capable of reacting with the diazonium salt compound to form a color.

particularly when the full-color thermal recording material has cyan, yellow and magenta-forming thermal recording layers, it is desirable that the first thermal recording layer nearest to the support contains a leuco-type color former of an electron-donating dye precursor and an electron-accepting compound, and the second and third thermal recording layers contain a diazo-type color former.

For example, the thermal recording material may be formed by embodiments expressed by the following (a)–(c).

(a) A recording material comprising a laminated structure of; a photo-fixing recording layer that contains the low sensitivity microcapsules of the present invention which encapsulate a diazonium salt compound (maximum absorption wavelength of 365±40 nm) therein, and a coupler capable of reacting with the diazonium salt compound to form a dye (first recording layer A); and a photo-fixing recording layer that contains a diazonium salt compound (maximum absorption wavelength of 420±40 nm) and a coupler capable of reacting with the diazonium salt compound to form a dye (second recording layer B). This recording material may have a light transmittance-controlling layer and a protective layer on the laminate structure, according to necessity.

(b) A recording material comprising a laminated structure of; a recording layer that contains the low sensitivity microcapsules of the present invention, which encapsulate an electron-donating dye precursor, and an electron-accepting compound (first recording layer A); a photo-fixing recording layer that contains a diazonium salt compound (maximum absorption wavelength of 365±40 nm), and a coupler capable of reacting with the diazonium salt compound to form a dye (second recording layer B); and a photo-fixing recording layer that contains a diazonium salt compound (maximum absorption wavelength of 420±40 nm) and a coupler capable of reacting with the diazonium salt compound to form a dye (third recording layer C) laminated on the support in that order. This recording material may have a light transmittance-controlling layer and a protective layer on the laminate structure, according to necessity.

(c) A recording material comprising a laminated structure of; a photo-fixing recording layer that contains the low sensitivity microcapsules of the invention, which encapsulate a diazonium salt compound (maximum absorption wavelength of at most 350 nm), and a coupler capable of reacting with the diazonium salt compound to form a dye (first recording layer A); a photo-fixing recording layer that contains a diazonium salt compound (maximum absorption wavelength of 365±40 nm), and a coupler capable of reacting with the diazonium salt compound to form a dye (second recording layer B); and a photo-fixing recording layer that contains a diazonium salt compound (maximum absorption wavelength of 420±40 nm) and a coupler capable of reacting with the diazonium salt compound to form a dye (third recording layer C) laminated on a support in that order. The recording material may have a light transmittance-controlling layer and a protective layer on the laminate structure, according to necessity.

When a surfactant such as that mentioned hereinabove is used in forming the low sensitivity microcapsules of the present invention to be in the laminate layer structure of the thermal recording material, the microcapsules can be formed stably. Therefore, in the thermal recording material of the present invention, it is preferable that the thermal recording layer with the microcapsules therein be further coated with at least one other thermal recording layer on its recoding surface, and it is more preferable that the thermal recording layer with the microcapsules therein is nearest to the support (lowermost layer).

Methods of forming full-color images on the embodiments (b) and (c) are described below.

First, the third recording layer (C) is heated, and the diazonium salt is reacted with the coupler therein to form a dye. Next, the recording material is exposed to light of which the emission center wavelength is 430±30 nm, whereby the non-reacted diazonium salt compound in the layer C is decomposed and the image, which has been formed is photo-fixed. Then, the recording material is exposed to heat sufficient to form a dye in the second recording layer (B), and the diazonium salt compound in the layer (B) is reacted with the coupler therein to form a dye. In this stage, the layer C is also strongly heated, but the diazonium salt compound therein has been already decomposed (that is, the image formed has been photo-fixed), and has lost its color-forming ability. Next, the recording material is exposed to light of which the emission center wavelength is 360±20 nm, whereby the diazonium salt compound in the layer B is decomposed and the image formed is photo-fixed. Finally, the recording material is exposed to heat sufficient to form a dye in the first recoding layer (A). In this stage, the layers (B) and (C) are also strongly heated, but the diazonium salt compounds therein have been already decomposed and have lost their color-forming ability. In cases where the thermal recording layer of the invention is the layer (A), it is preferable that the sensitivity of the microcapsules therein be no more than 60 mJ/mm$^2$ in terms of the recording energy to form yellow of O.D.=1.5, and more preferably no more than 55 mJ/mm$^2$. In cases where the thermal recording layer of the invention is the layer (B), it is preferable that the sensitivity of the microcapsules therein be no more than 100 mJ/mm$^2$ in terms of the recording energy to form magenta of O.D.=1.5, and more preferably no more than 95 mJ/mm$^2$. Preferably, the sensitivity to heat of the microcapsules with an electron-donating dye precursor or a diazonium salt compound encapsulated therein in the thermal recording material of the invention is low such that the color density of the image formed, in terms of the optical density, O.D. at a recording energy of 100 mJ/mm$^2$, is no more than 0.2. More preferably, the sensitivity to heat of the microcapsules with an electron-donating dye precursor or a diazonium salt compound encapsulated therein in the lowermost layer (A) in the thermal recording material of the invention is low such that the color density of the image (cyan image) formed, in terms of the optical density, O.D. at recording energy of 100 mJ/mm$^2$, is no more than 0.2. Controlling the sensitivity to heat of the microcapsules of the invention in the layer (A) (lowermost layer) to the range as above makes it possible to prevent the layer (A) from forming a color when heat is applied to the layer (B). Accordingly, color mixing in the image formed on the recoding material of the invention is prevented, and the thermal differentiation in the recording material is improved.

In cases where all the recording layers (A, B and C) in the recording material are diazo-type recording layers, the layers (A) and (B) must be photo-fixed after processed for color image formation, but the layer (C), which is finally processed for color image formation last, does not necessarily require photo-fixing.

The light source for photo-fixation may be selected from any known light sources. Examples include various fluorescent lamps, xenon lamps and mercury lamps. A light source of having an emission spectrum is almost the same as the absorption spectrum of the diazonium salt compound used in the recording material is especially preferable, as it enables high-efficiency photo-fixation.

Other Layers:

The thermal recording material of the present invention that has one or more thermal recording layers on a support preferably also has a light transmittance-controlling layer and a protective layer.

Light Transmittance-Controlling Layer:

The light transmittance-controlling layer contains a UV absorbent precursor, in which the precursor does not function as a UV absorbent before the layer is exposed to light necessary for image fixation. Therefore, before being exposed to light for image fixation, the light transmittance of the layer is high. When the photo-fixing thermal recording layers are exposed to light for image fixation thereon, the light transmittance-controlling layer transmits the light for image fixation well and transmits visible light well, and therefore does not interfere with image fixation on the recording layers. The UV absorbent precursor in the light transmittance-controlling layer is preferably encapsulated into microcapsules.

Examples of the compounds that may be in the light transmittance-controlling layer are given in JP-A No. 9-1928.

After the thermal recoding layers have been exposed to light for image fixation thereon, the UV absorbent precursor in the light transmittance-controlling layer receives light or heat and becomes able to funstion as a UV absorbent. Accordingly, almost all light falling within a UV range is absorbed by the UV absorbent in the light transmittance-controlling layer, and the UV light transmittance of the layer is lowered. As a result, the lightfastness of the image-recorded material is improved, but since the UV absorbent does not absorb visible light, the visible light transmittance of the image-recorded material does not substantially change.

At least one light transmittance-controlling layer may be in the thermal recording material of the invention, and most preferably, between the thermal recording layer and the outermost protective layer. However, the light transmittance-controlling layer may also serve as a protective layer. The characteristics of the light transmittance-controlling layer may be suitably determined, depending on the characteristics of the thermal recording layers in the recording material.

A coating liquid for forming the light transmittance-controlling layer (coating liquid for light transmittance-controlling layer) may be prepared by mixing the components mentioned above. The coating liquid can be applied onto the recording layer-coated material by any known coating method using, for example, a bar coater, an air knife coater, a blade coater or a curtain coater. The light transmittance-controlling layer may be formed simultaneously with the thermal recording layers; or after the coating liquids for the thermal recording layers have been applied onto a support and been dried thereon, the coating liquid for the light transmittance-controlling layer may be applied onto the recording layers.

A dry weight of the light transmittance-controllinglayer formed is preferably from 0.8 to 4.0 g/m$^2$.

Protective Layer:

The protective layer contains a binder, and also a pigment, a lubricant, a surfactant, a dispersant, a fluorescent brightener, a metal soap, a hardener, a UV absorbent, a crosslinking agent, and the like.

The binder may be any, which has not inhibit the barrier property of the protective layer or the workbility of the layer. Examples include polyvinyl alcohol, methyl cellulose, carboxymethyl cellulose, hydroxyethyl cellulose, starches, gelatin, arabic gum, casein, styrene-maleic anhydride copolymer hydrolyzate, ethylene-maleic anhydride copolymer hydrolyzate, isobutylene-maleic anhydride copolymer hydrolyzate, polyvinyl alcohol, modified polyvinyl alcohol, and polyacrylamide.

In addition to the above, synthetic rubber latexes and synthetic resin emulsions are also usable as the binder. For example, styrene-butadiene rubber latex, acrylonitrile-butadiene rubber latex, methyl acrylate-butadiene rubber latex, and polyvinyl acetate emulsion.

The binder content of the protective layer is preferably from 10 to 500% by weight, more preferably from 50 to 400% by weight of the pigment in the layer.

For improving the waterproofness of the protective layer, a crosslinking agent combined with a catalyst for promoting its reaction is effective. Examples of the crosslinking agent include epoxy compounds, blocked isocyanates, vinylsulfone compounds, aldehyde compounds, methylol compounds, boric acids, carboxylic acid anhydrides, silane compounds, chelate compounds and halide compounds, and those capable of controlling the pH of the coating liquid for the protective layer from 6.0 to 7.5 are preferable. The catalyst may be any known acid or metal salt. For it, those capable of controlling the pH of the coating liquid to be from 6.0 to 7.5 are also preferred.

Any known organic or inorganic pigment may be used in the protective layer. Specifically, examples of the pigment include calciumcarbonate, aluminium hydroxide, barium sulfate, titanium oxide, talc, agalmatolite, kaolin, calcined kaolin, amorphous silica, colloidal silica, urea-formalin resin powder, polyethylene resin powder, and benzoguanamine resin powder. One or more of these may be in the layer singly or in combinations of two or more.

Preferable examples of the lubricant that may be in the protective layer are zinc stearate, calcium stearate, paraffin wax, and polyethylene wax.

A surfactant is added to the coating liquid for the protective layer so that the protective layer can be uniformly formed on the thermal recording layers. Preferable examples thereof are alkali metal sulfosuccinates and fluorine-containing surfactants, and specifically, they are sodium salts and ammonium salts of di(2-ethylhexyl)sulfosuccinic acid and di(n-hexyl)sulfosuccinic acid.

The coating liquid for forming the protective layer (coating liquid for protective layer) may be obtained by mixing the above-mentioned components. If desired, a release agent, wax and a water repellent may be added thereto.

To produce the thermal recording material of the invention, the coating liquid may be applied to the thermal recording layers formed on a support to thereby form the protective layer thereon, by any ordinary coating method. For example, a bar coater, an air knife coater, a blade coater or a curtain coater may be used.

The protective layer may be formed simultaneously with the thermal recording layers and the light transmittance-controlling layer. Alternatively, the protective layer may be formed on the recording layers after the coating liquids for the thermal recording layers are applied onto a support and dried.

The dry weight of the protective layer is preferably from 0.2 to 7 g/m$^2$, more preferably from 1 to 4 g/m$^2$. If the dry weight is lower than 0.2 g/m$^2$, the protective layer might not be able to maintain water resistance; but if higher than 7 g/m$^2$, the thermal sensitivity of the recording material might be significantly lowered. After the protective layer has been formed, it may be optionally calendered.

Interlayer:

When the thermal recording layer comprises multiple layers, providing an interlayer between the neighboring thermal recording layers is preferable. Like the protective layer, the interlayer may contain a binder and also a pigment, a lubricant, a surfactant, a dispersant, a fluorescent brightener, a metal soap, a UV absorbent, and the like. The binder in the interlayer may be the same as that in the protective layer.

Support:

The support for the thermal recording layer of the invention is made of, for example, polyethylene terephthalate (PET), polyethylene naphthalate (PEN), triacetyl cellulose (TAC), paper, plastic resin-laminated paper, or synthetic paper. For transparent thermal recording materials, the support must be transparent. The transparent support may be a synthetic polymer film, including, for example, polyester films of polyethylene terephthalate or polybutylene terephthalate, cellulose triacetate film, and polyolefin films of polypropylene or polyethylene.

The support maybe a single-layered support or a laminated support.

The thickness of the synthetic polymer films for the support is preferably from 25 to 300 $\mu$m, and more preferably from 100 to 250 $\mu$m.

The synthetic polymer films may be colored in any desired manner. Examples of coloring methods include <1> previously kneading a dye in resin before the resin is formed into films, and the dye-containing resin is formed into a film; or <2> dissolving a dye in a suitable solvent to prepare a dye solution, and applying this onto a transparent colorless resin films in an ordinary coating method, and dried thereon. Examples of the coating and drying methods include gravure coating, roller coating and wire coating. Among these examples, films of polyethylene terephthalate or polyethylene naphthalate containing a blueing dye are preferable. The films may be thermally processed, stretched or processed for static charge prevention.

The thermal recording layers, the protective layer, the light transmittance-controlling layer and the interlayer mentioned above may be formed on a support by any known coating method, and dried thereon. Examples of the known coating method include blade coating, air knife coating, gravure coating, roll coating, spraying, dipping, and bar coating. If desired, the back surface of the support, which is not coated with the thermal recording layers may be coated with a back coat layer, or an adhesive layer (sealant layer) combined with a release layer.

EXAMPLES

The invention is described in more detail with reference to the following Examples. However, these examples are not intended to restrict the scope of the present invention.

Example 1

Preparation of Aqueous Solution of Phthalated Gelatin 32 parts by weight of phthalated gelatin (trade name: MGP GELATIN, provided by Nippi Collagen), 0.9143 parts by weight of 1,2-benzothiazolin-3-one (3.5% solution in methanol provided by Daito Chemical Industry), and 367.1 parts by weight of ion-exchanged water were mixed and dissolved at 40° C. to prepare an aqueous solution of phthalated gelatin.

Preparation of Aqueous Solution of Alkali-Processed Gelatin 25.5 parts by weight of alkali-processed low-ion gelatin (trade name: #750 GELATIN, provided by Nitta Gelatin), 0.7286 parts by weight of 1,2-benzothiazolin-3-one (3.5% solution in methanol, provoded by Daito Chemical Industry), 0.153 parts by weight of calcium hydroxide, and 143.6 parts by weight of ion-exchanged water were mixed and dissolved at 50° C. to prepare an aqueous solution of alkali-processed gelatin.

Preparation of Coating Liquid (a) for Yellow Thermal Recording Layer

Preparation of Diazonium Salt Compound-Containing Microcapsule Dispersion (a)

2.2 parts by weight of a diazonium salt compound (A) mentioned below (maximum absorption wavelength: 420 nm), 2.2 parts by weight of a diazonium salt compound (B) mentioned below (maximum absorption wavelength: 420 nm), 4.8 parts by weight of monoisopropylbiphenyl, 4.8 parts by weight of diphenyl phthalate, and 0.4 parts by weight of diphenyl(2,4,6-trimethylbenzoyl) phosphine oxide (trade name: LUCILIN TPO, provided by BASF Japan), were added to 16.1 parts by weight of ethyl acetate and uniformly dissolved under heat at 40° C.

11.0 parts by weight of a capsule wall-forming material, which is a mixture of xylylene diisocyanate/trimethylolpropane adduct and xylylene diisocyanate/bisphenol A adduct (trade name: TAKENATE D119N (50 wt. % solution in ethyl acetate) provided by Takeda Chemical Industry), was added to this mixture and uniformly stirred to prepare a mixture (I).

16.3 parts by weight of ion-exchanged water and 0.34 parts by weight of an aqueous solution of 50 wt. % alkylglucoside surfactant (trade name: SCRAPH AG-8, provided by Nippon Seika) were added to 58.6 parts by weight of the aqueous solution of phthalated gelatin to separately prepare a mixture (II).

The mixture (I) was added to the mixture (II), and emulsified and dispersed at 40° C. by a homogenizer (provided by Nippon Seiki Seisakusho). 20 parts by weight of water was added to the resulting emulsion and uniformly mixed. Afterwards, this mixture was stirred and ethyl acetate was removed therefrom at 40° C., while performing the encapsulating reaction for three hours. Next, an ion-exchange resin Amberlite (6.2 parts by weight of IRA68 (trade name), provided by Organo, and 12.4 parts by weight of IRC50 (trade name) provided by Organo) was added thereto, and further stirred for 1 hour. Next, the ion-exchange resin was removed through filtration, and the resulting dispersion was processed to have a solid content of 20%, thus obtaining a diazonium salt compound-containing microcapsule dispersion (a). The grain size of the microcapsules formed was measured with a grain size analyzer (trade name: LA-700, provided by Horiba Seisakusho); the median diameter was found to be 0.36 μm.

Diazonium Salt Compound A

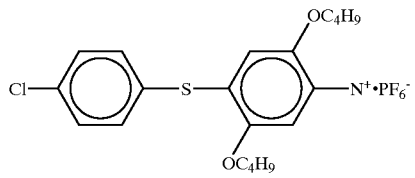

Diazonium Salt Compound B

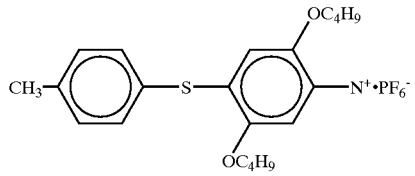

Preparation of Coupler Emulsion (a):

9.9 parts by weight of a coupler (C) mentioned below, 9.9 parts by weight of triphenylguanidine (provided by Hodogaya Chemical), 20.8 parts by weight of 4,4'-(m-phenylenediisopropylidene)diphenol (trade name: BISPHENOL M, provided by Mitsui Petrochemical), 3.3 parts by weight of 3,3,3',3'-tetramethyl-5,5',6,6'-tetra(1-propyloxy)-1,1'-spyrobisindane (provided by Sankyo Chemical), 13.6 parts by weight of 4-(2-ethyl-1-hexyloxy) benzenesulfonamide (provided by Manac), 6.8 parts by weight of 4-n-pentyloxybenzenesulfonamide (provided by Manac), and 4.2 parts by weight of calcium dodecylbenzenesulfonate (trade name: PIONIN A-41-C, 70% solution in methanol, provided by Takemoto Yushi) were dissolved in 33.0 parts by weight of ethyl acetate to prepare a mixture (III).

206.3 parts by weight of the aqueous solution of alkali-processed gelatin was mixed with 107.3 parts by weight of ion-exchanged water to separately prepare a mixture (IV).

The mixture (III) was added to the mixture (IV), and emulsified and dispersed at 40° C. by a homogenizer (provided by Nippon Seiki Seisakusho). The resulting coupler emulsion was heated under reduced pressure to remove ethyl acetate, and then processed to have a solid content of 26.5% by weight. The grain size of the grains in the coupler emulsion was measured with a grain size analyzer (trade name: LA-700, provided by Horiba Seisakusho), and a median diameter thereof was 0.21 μm.

9 parts by weight of 26.5 wt. % SBR latex (trade name: SN-307, 48 wt. % solution, provided by Sumika ABS Latex) was added to 100 parts by weight of the coupler emulsion, and uniformly stirred to prepare a coupler emulsion (a).

Coupler Compound C

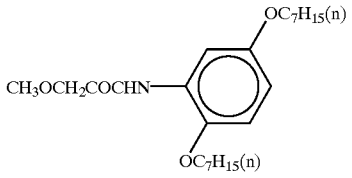

Preparation of Coating Liquid (a) for Yellow Thermal Recording Layers

The diazonium salt compound-containing microcapsule dispersion (a) and the coupler emulsion (a) were mixed in a coupler/diazonium salt compound ratio by weight of 2.2/1 to prepare a coating liquid (a) for yellow thermal recording layers.

Preparation of Coating liquid (b) for Magenta Thermal Recording Layers

Preparation of Diazonium Salt Compound-Containing Microcapsule Dispersion (b)

2.8 parts by weight of a diazonium salt compound (D) mentioned below (its maximum absorption wavelength is 365 nm) 2.1 parts by weight of diphenyl phthalate, 6.1 parts by weight of phenyl 2-benzoyloxybenzoate, 3.7 parts by weight of TMPT, and 0.1 parts by weight of calcium dodecylbenzenesulfonate (trade name: PIONIN A-41-C, 70% solution in methanol, provided by Takemoto Yushi), were added to 15.1 parts by weight of ethyl acetate and uniformly dissolved under heat.

Capsule wall-forming materials, 2.5 parts by weight of a mixture of xylylene diisocyanate/trimethylolpropane adduct and xylylene diisocyanate/bisphenol A adduct (trade name: TAKENATE D119N (50 wt. % solution in ethyl acetate), provided by Takeda Chemical Industry), and 6.8 parts by weight of xylylene diisocyanate/trimethylolpropane adduct (trade name: TAKENATE D110N (75 wt. % solution in ethyl acetate), provided by Takeda Chemical Industry), were added to the above mixture and uniformly stirred to prepare a mixture (V). p 21.0 parts by weight of ion-exchanged water was added to 55.3 parts by weight of the aqueous solution of phthalated gelatin, and mixed to separately prepare a mixture (VI).

The mixture (V) was added to the mixture (VI), and emulsified and dispersed at 40° C. by a homogenizer (by Nippon Seiki Seisakusho). 30 parts by weight of water was added to the resulting emulsion and uniformly mixed. This was stirred at 40° C. for 3 hours to form microcapsules, while removing ethyl acetate. Next, an ion-exchange resin Amberlite (4.1 parts by weight of IRA68 (trade name), provided by Organo, and 8.2 parts by weight of RC50, (trade name), provided by organo) was added thereto, and stirred for 1 hour. The ion-exchange resin was removed through filtration, and the resulting dispersion was processed to have a solid content of 20%. This is a diazonium salt compound-containing microcapsule dispersion (b). The grain size of the microcapsules formed was measured with a grain size analyzer (trade name: LA-700, provided by Horiba Seisakusho); was found to be 0.43 μm the median diameter.

Diazonium Salt Compound D:

Diazonium Salt Compound D

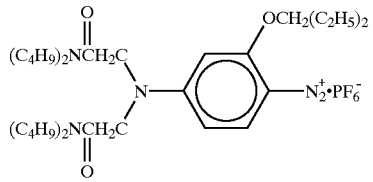

Preparation of Coupler Emulsion (b)

11.9 parts by weight of a coupler (E) mentioned below, 14.0 parts by weight of triphenylguanidine (provided by Hodogaya Chemical), 14.0 parts by weight of 4,4'-(m-phenylenediisopropylidene)diphenol (trade name: BISPHENOL M, provided by Mitsui Petrochemical), 14 parts by weight of HF-209 (trade name, provided by Honshu Chemical), 3.5 parts by weight of 3,3,3',3'-tetramethyl-5,5',6,6'-tetra(1-propyloxy)-1,1'-spyroindane (provided by Sankyo Chemical), 3.5 parts by weight of 2,2'-(2-methinepropylidene)-bis(4,6-dimethylphenyl), 1.7 parts by weight of tricresyl phosphate, 0.8 parts by weight of diethyl maleate, and 4.5 parts by weight of calcium dodecylbenzenesulfonate (trade name: PIONIN A-41-C, 70% solution in methanol, provided by Takemoto Yushi) were dissolved in 36.9 parts by weight of ethyl acetate to prepare a mixture (VII).

206.3 parts by weight of the aqueous solution of alkali-processed gelatin was mixed with 107.3 parts by weight of ion-exchanged water to separately prepare a mixture (VIII).

The mixture (VII) was added to the mixture (VIII), and emulsified and dispersed at 40° C. by a homogenizer (provided by Nippon Seiki Seisakusho). The resulting coupler emulsion was heated under reduced pressure to remove ethyl acetate, and then processed to have a solid content of 24.5% by weight. This is a coupler emulsion (b). The grain size of the grains in the coupler emulsion was measured with a grain size analyzer (trade name: LA-700, provided by Horiba Seisakusho), and the median diameter thereof was found to be 0.22 μm.

Coupler E

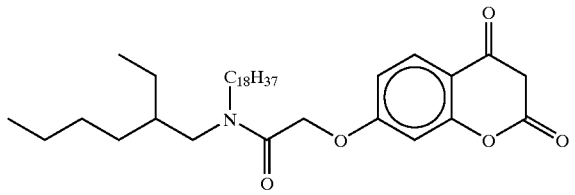

Preparation of Coating Liquid (b) for Magenta Thermal Recording Layers

The diazonium salt compound-containing microcapsule dispersion (b) and the coupler emulsion (b) were mixed to have coupler/diazonium salt compound a ratio by weight of 4.5/1. This was further mixed with 0.2 parts by weight, relative to 10 parts by weight of the microcapsule dispersion (b), of an aqueous solution of 5 wt. % polystyrenesulfonic acid (partially neutralized with potassium hydroxide) to prepare a coating liquid (b) for magenta thermal recording layers.

Preparation of Coating Liquid (c) for Cyan Thermal Recording Layers

Preparation of Electron-Donating Dye Precursor-Containing Microcapsule Dispersion (c)

5.0 parts by weight of an electron-donating dye precursor (F) mentioned below, 8.0 parts by weight of a mixture of 1-methylpropylphenyl-phenylmethane and 1-(1-methylpropylphenyl)-2-phenylethane (tradename: HISOL SAS-310, provided by Nippon Oil), and 8.0 parts by weight of IRGAPERM 2140 (trade name, provided by Ciba Speciality Chemicals) were added to 18.1 parts by weight of ethyl acetate, and uniformly dissolved under heat.

Capsule wall-forming materials, 7.2 parts by weight of xylylene diisocyanate/trimethylolpropane adduct (trade name: TAKENATE D110N (75 wt. % solution in ethyl acetate), provided by Takeda Chemical Industry) and 5.3 parts by weight of polymethylene-polyphenyl polyisocyanate (trade name: MILLIONATE MR-200, provided by Nippon Polyurethane Industry) were added to the mixture, and uniformly stirred to prepare a mixture (IX).

9.5 parts by weight of ion-exchanged water, 0.17 parts by weight of an aqueous solution of 50 wt. % alkylglucoside surfactant (trade name: SCRAPH AG-8, provided by Nippon Seika —which is surfactant (I) in the present invention), and 0.43 parts by weight of an aqueous solution of 10 wt. % sodium dodecylbenzenesulfonate (this is surfactant (II) in the invention) were added to 28.8 parts by weight of the aqueous solution of phthalated gelatin to separately prepare a mixture (X).

The mixture (IX) was added to the mixture (X), and emulsified and dispersed at 40° C. by a homogenizer (provided by Nippon Seiki Seisakusho). 50 parts by weight of water and 0.12 parts by weight of diethylenetriamine were added to the resulting emulsion and uniformly mixed. This was stirred at 65° C. for 3 hours to form microcapsules, while removing ethyl acetate. The resulting microcapsule dispersion was processed to have a solid content of 33 wt. %. The grain size of the microcapsules formed was measured with a grain size analyzer (trade name: LA-700, provided by Horiba Seisakusho), and the median diameter was found to be 1.00 $\mu$m.

3.7 parts by weight of an aqueous solution of 25 wt. % sodium dodecylbenzenesulfonate (trade name: NEOPELEX F-25, provided by Kao) and 4,4'-bistriazinylaminostilbene-2,2'-disulfone derivative (trade name: KAYCALL BXNL, provided by Nippon Soda) were added to 100 parts by weight of the microcapsule dispersion, and uniformly stirred. This is an electron-donating dye precursor-containing microcapsule dispersion (c).

Electron-Donating Dye Precursor F

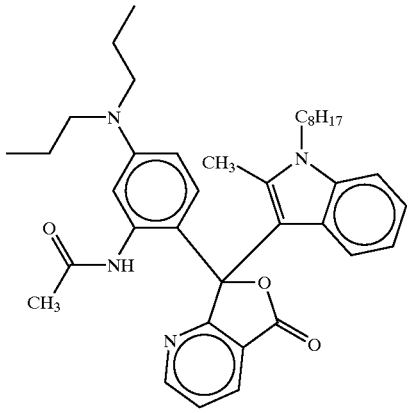

Preparation of Electron-accepting Compound Dispersion (c)

30.1 parts by weight of ion-exchanged water, 15 parts by weight of 4,4'-(p-phenylenediisopropylidene)diphenol (trade name: BISPHENOL P, provided by Mitsui Petrochemical), and 3.8 parts by weight of an aqueous solution of 2 wt. % sodium 2-ethylhexylsuccinate were added to 11.3 parts by weight of the aqueous solution of phthalated gelatin, and dispersed in a ball mill overnight to prepare a dispersion. A solid content thereof was 26.6% by weight.

45.2 parts by weight of the alkali-processed aqueous solution was added to 100 parts by weight of the dispersion, and stirred for 30 minutes. Ion-exchanged water was added to this to make the resulting dispersion have a solid content of 23.5% by weight. This is an electron-accepting compound dispersion (c)

Preparation of Coating Liquid (c) for Cyan Thermal Recoding Layers

The electron-donating dye precursor-containing microcapsule dispersion (c) and the electron-accepting compound dispersion (c) were mixed in an electron-accepting compound/electron-donating dye precursor of 10/1 ratio by weight to prepare a coating liquid (c) for cyan thermal recording layers.

Preparation of Coating Liquid for Interlayers 100.0 parts by weight of an aqueous solution of alkali-processed low-ion gelatin (trade name: #750 GELATIN, provided by Nitta Gelatin), 2.857 parts by weight of 1,2-benzothiazolin-3-on (3.5 wt. % solution in methanol, by Daito Chemical Industry), 0.5 parts by weight of calcium hydroxide, and 521.643 parts by weight of ion-exchanged water were mixed and dissolved at 50° C. to prepare an aqueous gelatin solution for interlayers.

10.0 parts by weight of the aqueous gelatin solution for the interlayer, 0.05 parts by weight of sodium (4-nonylphenoxytrioxyethylene)butylsulfonate (provided by Sankyo Chemical, aqueous 2.0 wt. % solution), 1.5 parts by weight of boric acid (aqueous 4.0 wt. % solution), 0.19 parts by weight of an aqueous solution of 5 wt. % polystyrenesulfonic acid (partially neutralized with potassium hydroxide), 4.53 parts by weight of H-603M (trade name, provided by Wako Pure Chemicals), and 0.67 parts by weight of ion-exchanged water were mixed to prepare a coating liquid for interlayers.

Preparation of Coating Liquid for Light Transmittance-Controlling Layes

Preparation of UV Absorbent Precursor-Containing Microcapsule Dispersion 14.5 parts by weight of a UV absorbent precursor, [2-allyl-6-(2H-benzotriazol-2-yl)-4-t-octylphenyl] benzenesulfonate, 5.0 parts by weight of 2,2'-t-octylhydroquinone, 1.9 parts by weight of tricresyl phosphate, 5.7 parts by weight of α-methylstyrene dimer (trade name: MSD-100, provided by Mitsui Chemical), and 0.45 parts by weight of calcium dodecylbenzenesulfonate (trade name: PIONIN A-41-C (70% solution in methanol), provided by Takemoto Yushi) were added to 71 parts by weight of ethyl acetate, and uniformly dissolved. 54.7 parts by weight of a capsule wall-forming material, xylylene diisocyanate/trimethylolpropane adduct (trade name: TAKENATE D110N (75 wt. % solution in ethyl acetate), provided by Takeda Chemical Industry) was added to To the mixture, and uniformly stirred to prepare a UV absorbent precursor-containing mixture.

8.9 parts by weight of an aqueous 30 wt. % phosphoric acid solution and 532.6 parts by weight of ion-exchanged water were mixed with 52 parts by weight of itaconic acid-modified polyvinyl alcohol (trade name: KL-318, provided by Kuraray) to prepare an aqueous PVA solution for UV absorbent precursor-containing microcapsule dispersion.

The UV absorbent precursor-containing mixture was added to 516.06 parts of the aqueous PVA solution for UV absorbent precursor-containing microcapsule dispersions, and emulsified and dispersed at 20° C. by a homogenizer (by Nippon Seiki Seisakusho). 254.1 parts by weight of ion-exchanged water was added to the resulting emulsion and uniformly mixed. This was stirred at 40° C. for 3 hours to form microcapsules. Next, 94.3 parts by weight of an ion-exchange resin Amberlite (trade name: MB-3, provided by Organo) was added thereto, and stirred for 1 hour. Next, the ion-exchange resin was removed through filtration, and the resulting microcapsule dispersion was processed to have a solid content of 13.5%. The grain size of the microcapsules formed was measured with a grain size analyzer (trade name: LA-700, provided by Horiba Seisakusho), and the median diameter was found to be 0.23±0.05 μm. 859.1 parts by weight of the microcapsule dispersion was mixed with 2.416 parts by weight of carboxy-modified styrene-butadiene latex (tradename: SN-307 (aqueous 48 wt. % solution), provided by Sumitomo Norgatta) and 39.5 parts by weight of ion-exchanged water to prepare a UV absorbent precursor-containing microcapsule dispersion.

Preparation of Coating Liquid for Light Transmittance-Controlling Layers 1000 parts by weight of the UV absorbent precursor-containing microcapsule dispersion, 5.2 parts by weight of MEGAFAC F-120 (by Dai-Nippon Ink Chemical Industry, aqueous 5 wt. % solution), 7.75 parts by weight of aqueous 4 wt. % sodium hydroxide solution, and 73.39 parts by weight of sodium (4-nonylphenoxytrioxyethylene) butylsulfonate (by Sankyo Chemical, aqueous 2.0 wt. % solution) were mixed to prepare a coating liquid for light transmittance-controlling layers.

Preparation of Coating Liquid for Protective Layer

Preparation of Polyvinyl Alcohol Solution for Protective Layers 160 parts by weight of vinyl alcohol-alkyl vinyl ether copolymer (trade name: EP-130, provided by Denki Kagaku Kogyo), 8.74 parts by weight of a mixture of sodium alkylsulfonate and polyoxyethylene alkyl ether phosphate (trade name: NEOSCORE CM-57 (aqueous 54 wt. % solution) provided by Toho Chemical Industry), and 3832 parts by weight of ion-exchanged water were mixed and dissolved at 90° C. for 1 hour to prepare a uniform polyvinyl alcohol solution for protective layers.

Preparation of Pigment Dispersion for Protective Layers 8 parts by weight of barium sulfate (trade name: BF-21F, having a barium sulfate content of at least 93%, provided by Sakai Chemical Industry) was mixed with 0.2 parts by weight of anionic, special polycarboxylic acid-type polymer surfactant (trade name: POISE 532A (aqueous 40 wt. % solution), provided by Kao) and 11.8 parts by weight of ion-exchanged water, and dispersed by a dino mill. Measured with a grain size analyzer (trade name: LA-910, provided by Horiba Seisakusho), the median diameter of the grain size of the grains in the dispersion was at most 0.15 μm.

8.1 parts by weight of colloidal silica (trade name: SNOWTEX O (aqueous 20 wt. % dispersion), provided by Nissan Chemical) was added to 45.6 parts by weight of the dispersion to prepare a pigment dispersion for protective layers.

Preparation of Matting Agent Dispersion for Protective Layers 220 parts by weight of wheat starch (trade name: WHEAT STARCH S, provided by Shinshin Foods) was mixed with 3.81 parts by weight of an aqueous dispersion of 1,2-benzisothiazolin-3-on (trade name: PROXEL BD, provided by ICI) and 1976.19 parts by weight of ion-exchanged water, and uniformly dispersed to prepare a matting agent dispersion for protective layer.

Preparation of Coating Blend for the Protective Layer 1000 parts by weight of the polyvinyl alcohol solution for protective layer, 40 parts by weight of W-1016 (trade name: MEGAFAC F-120, provided by Dai-Nippon Ink Chemical Industry) (aqueous 5 wt. % solution), 50 parts by weight of sodium (4-nonylphenoxytrioxyethylene)butylsulfonate (by Sankyo Chemical, aqueous 2.0 wt. % solution), 49.87 parts by weight of the pigment dispersion for protective layer, 16.65 parts by weight of the matting agent dispersion for protective layer, and 48.7 parts by weight of zinc stearate dispersion (trade name: HIDRIN 115, aqueous 20.5 wt. % solution, provided by Chukyo Yushi) were uniformly mixed to prepare a coating blend for protective layer.

Formation of Undercoat Layer-Coated Support

Preparation of Coating Liquid for Undercoat Layers 40 parts by weight of enzyme-degraded gelatin (mean molecular weight 10000; PAGI viscosity 1.5 mP·s (15 mP); PAGI jelly strength 20 g) was added to 60 parts by weight of ion-exchanged water, and dissolved while stirring at 40° C. to prepare an aqueous gelatin solution for undercoat layers.

On the other hand, 8 parts by weight of water-swellable synthetic mica (aspect ratio 1000; trade name: SOMASHIF ME100, provided by Corp Chemical) was mixed with 92 parts by weight of water, and wet-milled in a visocomill to prepare a mica dispersion having a volume-average grain size of 2.0 μm. Water was added to the mica dispersion to make it have a mica content of 5% by weight, and uniformly mixed. This is the desired mica dispersion.

Next, 120 parts by weight of water and 556 parts by weight of methanol were added to 100 parts by weight of the aqueous 40 wt. % gelatin solution for undercoat layers at 40° C., and well stirred and mixed. Then, 208 parts by weight of the 5 wt. % mica dispersion was added to this mixture stirred and mixed well, and 9.8 parts by weight of 1.66 wt. % polyethylene oxide-type surfactant was added thereto. With the liquid temperature kept at 35 to 40° C., 7.3 parts by weight of an epoxy compound serving as a gelatin hardener was added to it to prepare a coating liquid (5.7 wt. %) for undercoat layers.

Formation of Undercoat Layer-Coated Support

Using a double-disc refiner, wood pulp of LBPS and LBPK, 50/50 parts by weight was beaten to a Canadian freeness of 300 ml. To this were added 0.5 parts by weight, in terms of absolute dry weight relative to the pulp—the same definition applies to the other additives, of epoxidated behenamide, 1.0 part by weight of anionic polyacrylamide, 1.0 part by weight of aluminium sulfate, 0.1 parts by weight of polyamide-polyamine-epichlorohydrin, and 0.5 parts by weight of cationic polyacrylamide. Using a Fourdrinier machine, the paper stock thus-prepared was made into base paper having a unit weight of 114 g/m$^2$, and this was calendered to have a thickness of 100 μm.

The base paper were subjected to a corona discharge treatment on both surfaces thereof. Polyethylene resin was extruded through a melt extruder onto the base paper to form a matted resin layer thereon having a thickness of 36 μm (the resin-coated surface of the paper is referred to as a "back") Next, also using a melt extruder, the other surface of the paper, which is opposite to the resin-coated back, was coated with polyethylene resin containing 10% by weight of anatase-type titanium dioxide and a slight amount of ultramarine, to thereby form a glossy resin layer thereon having a thickness of 50 μm (this surface is referred to as "face"). The polyethylene resin-coated back of the paper was subjected to corona discharge treatment, and an aqueous dispersion of an antistatic agent, aluminium oxide (trade name: ALUMINA SOL 100, provided by Nissan Chemical Industry)/silicon dioxide (trade name: SNOWTEX O, provided by Nissan Chemical Industry)=½ (by weight) was applied to the back to form a layer thereon having a dry weight of 0.2 g/m$^2$. Next, the polyethylene resin-coated face of the paper was also subjected to corona discharge treatment, and the coating liquid for undercoat layer was applied to the face to form a undercoat layer thereon. The coating amount of the undercoat layer was 0.26 g/m$^2$ in terms of mica therein. Thus, a undercoat layer-coated support was formed Support Coating with Coating Liquids for Thermal Recording Layers The undercoat layer-coated face of the support was coated continuously with the coating liquid (c) for cyan thermal recording layer, the coating liquid for interlayers (interlayer A), the coating liquid (b) for magenta thermal recording layers, the coating liquid for interlayers (interlayer B), the coating liquid (a) for yellow thermal recording layers, the coating liquid for light transmittance-controlling layers, and the coating liquid for protective layers, to form the seven layers on the face of the support in that order, and then continuously dried at 30° C. and 30% RH and at 40° C. and 30% RH to form a full-color thermal recording material.

The coating amount of the coating liquid (a) for yellow thermal recording layers was 0.078 g/m$^2$ in terms of the solid content of the diazonium salt compound (A) in the liquid; that of the coating liquid (b) for magenta thermal recording layers was 0.206 g/m$^2$ in terms of the solid content of the diazonium salt compound (D) therein; and that of the coating liquid (c) for cyan thermal recording layers was 0.355 g/m$^2$ in terms of the solid content of the electron-donating dye precursor (F) therein.

The coating amount of the coating liquid for interlayers A was 3.34 g/m$^2$ in terms of the solid content of the layer; that for interlayer B was 2.39 g/m$^2$ in terms of the solid content thereof; the coating amount of the coating liquid for light transmittance-controlling layer was 2.35 g/m$^2$ in terms of the solid content of the layer; and that of the coating liquid for protective layer was 1.39 g/m$^2$ in terms of the solid content thereof.

Formation of Back Coat Layer

Preparation of Coating Liquid for Back Coat Layer A (Uppermost Layer)

Preparation of Aqueous Solution of Alkali-Processed Gelatin for Back Coat Layers 25 parts by weight of alkali-processed gelatin (trade name: PBLC GELATIN, provided by PB Gelatins, England), 75 parts by weight of alkali-processed gelatin (trade name: PR GELATIN, provided by Miyagi Chemical Industry), 2.95 parts by weight of 1,2-benzothiazolin-3-on (3.5 wt. % solution in methanol, by Daito Chemical Industry), and 450 parts by weight of ion-exchanged water were mixed and dissolved at 50° C. to prepare an aqueous, alkali-processed gelatin solution for back coat layers.

Preparation of Silica Dispersion 100 parts by weight of amorphous silica (trade name: MIZUKASIL P526A, provided by Mizusawa Chemical Industry) was mixed with 2.5 parts by weight of aqueous 40% sodium hexametaphosphate, 10 parts by weight of a polycarboxylic acid-type dispersant (trade name: POISE 520A, provided by Kao) and 880 parts by weight of ion-exchanged water and stirred to prepare a silica dispersion having a mean grain size of 6μ (measured with LA700 (trade name), provided by Horiba Seisakusho).

Preparation of Coating Liquids 1000 parts by weight of the aqueous, alkali-processed gelatin solution for back coat layers, 4500 parts by weight of the silica dispersion, 25 parts by weight of an aqueous solution of 70% sulfosuccinate-type surfactant (trade name: RAPISOL B90, provided by Nippon Yushi), and 1000 parts by weight of ion-exchanged water were mixed to prepare a coating liquid for back coat layer A.

Preparation of Coating Liquid for Back Coat Layer B (Under Layer)

1000 parts by weight of the aqueous, alkali-processed gelatin solution for back coat layer, 2 parts by weight of an aqueous solution of 70% sulfosuccinate-type surfactant (trade name: RAPISOL B90, provided by Nippon Yushi), 300 parts by weight of ion-exchanged water, and 200 parts by weight of AQUABRID EM-13 (by Daicel Chemical Industry) were mixed to prepare a coating liquid for back coat layers B.

Formation of Back Coat Layers

The surface of the support opposite to that coated with the thermal recording layers of the full-color thermal recording material was coated continuously with back coat layer B and back coat layer A in that order, and dried at 30° C. and 30% RH and at 40° C. and 30% RH, like the thermal recording layers as above, to thereby form the two-layered back coat layer.

The coating amounts of the back coat layer B and the back coat layer A were 10 g/m$^2$ and 1.0 g/m$^2$, respectively, in terms of the solid content of the layer.

Formation of Release Sheet

Coating Release Sheet Substrate with Release Layer

A biaxially-stretched foam film produced by stretching pigment-containing polyethylene terephthalate (trade name: CRYSPER, provided by Toyobo, which is a foam PET film flattened with rolls to have a thickness of 100 $\mu$m or 75 $\mu$m) was used as a release sheet substrate. Using a Mayer bar, this sheet was coated with a silicone release agent (trade name: LTC-750A, provided by Toray Dow Corning Silicone) to form thereon a release layer having a dry weight of 0.2±0.05 g/m$^2$, thus obtaining a release sheet used herein.

Back Printing on Release Sheet

Codes for the registration marks for prints in TA printers, the print formats, the customers, and the like, were printed on the surface of the release sheet opposite to that coated with the release layer. The printing ink was prepared by mixing 100 parts by weight of PANACIA CVL-SP805 (trade name, provided by Dai-Nippon Ink Chemical), 8 parts by weight of PANACIA CVL HARDENER #10 (trade name, provided by Dai-Nippon Ink Chemical) and 10 parts by weight of USL FILM REINFORCE (trade name, provided by Dai-Nippon Ink Chemical) followed by diluting the resulting blend with a diluent, DIREJUCER UR #2 (trade name, provided by Dai-Nippon Ink Chemical). Using the blend ink, the codes were printed on that surface of the release sheet in a mode of gravure printing.

Lamination 2 parts by weight of a crosslinking agent, polyfunctional aromatic isocyanate (trade name: CORONATE L, provided by Nippon Polyurethane Industry) was added to 100 parts by weight of an acrylic adhesive (trade name: BPS-4849-40N, provided by Toyo Ink), and well stirred. Using an applicator, this was applied onto the release agent-coated surface of the release sheet to form thereon an adhesive layer having a dry weight of 15±2 g/m$^2$. The adhesive-coated release sheet was laminated on the back coat layer of the full-color thermal recording material, which has the release sheet on its back, thus obtaining the thermal recording material of Example 1.

Comparative Example 1

A full-color thermal recording material of Comparative Example 1 was produced in the same manner as in Example 1, except that "0.17 parts by weight of the aqueous 50 wt. % alkylglucoside surfactant (trade name: SCRAPH AG-8, provided by Nippon Seika, which is surfactant (I)) and 0.43 parts by weight of the aqueous 10 wt. % solution of sodium dodecylbenzenesulfonate (this is surfactant (II))" were changed to "1.28 parts by weight of an aqueous 10 wt. % sodium dodecylbenzenesulfonate solution" in preparing the electron-donating dye precursor-containing microcapsule dispersion (c) of Example 1.

Comparative Example 2

A full-color thermal recording material of Comparative Example 2 was produced in the same manner as in Comparative Example 1, except that the reaction temperature in preparing the electron-donating dye precursor-containing microcapsule dispersion (c) of Comparative Example 1 was changed from "65° C." to "55° C.".

Evaluation

Thermal Recording

Images were recorded on the full-color thermal recording materials obtained above, according to the condition mentioned below.

A printer, TRT-21 (trade name, provided by Nagano Nippon Musen) was used to record a yellow image on the recording materials, in which the printing power and the pulse width were controlled so that the recording energy could be from 0 to 71 mJ/mm$^2$ per the unit area.

Next, the materials were exposed to a UV lamp (emission center wavelength 420 nm, power 40 W) for 10 seconds to fix the yellow image on the yellow thermal recording layer. Then, the printing power and the pulse width were controlled so that the recording energy from the thermal head could vary according to the printing steps as in Table 1 below and a magenta color was recorded.

Finally, the materials were exposed to a UV lamp (emission center wavelength 365 nm, power 40 W) for 15 seconds to fix the magenta image on the magenta thermal recording layer; then the printing power and the pulse width were so controlled that the recording energy from the thermal head could be from 0 to 137 mJ/mm$^2$ and a cyan image was recorded.

Measurement of Color Density

In every printing step of Table 1, the cyan color density of the image-recorded materials was measured with a Macbeth densitometer (trade name, provided RD-918 by Macbeth). The results are given in Table 1.

TABLE 1

| Printing Step | Recording Energy mJ/mm$^2$ | Example 1 | Comparative Example 1 | Comparative Example 2 |
|---|---|---|---|---|
| 0 | 0.0 | 0.11 | 0.11 | 0.11 |
| 1 | 26.5 | 0.11 | 0.11 | 0.11 |
| 2 | 37.6 | 0.11 | 0.11 | 0.11 |
| 3 | 48.8 | 0.11 | 0.11 | 0.11 |
| 4 | 59.9 | 0.11 | 0.11 | 0.11 |
| 5 | 71.0 | 0.11 | 0.11 | 0.11 |
| 6 | 82.1 | 0.10 | 0.11 | 0.11 |
| 7 | 93.2 | 0.11 | 0.11 | 0.25 |
| 8 | 104.3 | 0.24 | 0.23 | 0.55 |
| 9 | 115.5 | 0.62 | 0.60 | 0.98 |
| 10 | 126.6 | 1.05 | 1.08 | 1.47 |
| 11 | 137.7 | 1.53 | 1.53 | 1.74 |
| 12 | 148.8 | 1.76 | 1.74 | 1.86 |
| 13 | 159.9 | 1.84 | 1.82 | 1.85 |
| 14 | 171.1 | 1.84 | 1.82 | 1.85 |

As in Table 1, the full-color thermal recording material of Example 1 had a low cyan density, and the thermal differentiation in yellow, magenta and cyan therein was good.

The full-color thermal recording material of Comparative Example 1 also had a low cyan density like that of Example 1. However, the electron-donating dye precursor-containing microcapsule dispersion (c) was difficult to stably prepare, since the reaction system foamed a lot when forming the microcapsules and a lot of bubbles stayed in the upper part of the reactor, and the productivity of the recoding material of Comparative Example 1 was low.

Furthermore, in Comparative Example 2, foaming could be suppressed during the encapsulating reaction for the electron-donating dye precursor-containing microcapsule dispersion (c). However, the cyan density of the image-recorded material was high, and the thermal differentiability of the recording material of Comparative Example 2 is not good.

The invention provides a thermal recording material having the advantages of excellent production applicability, production stability and thermal differentiation.

What is claimed is:

1. A thermal recording material comprising a support and at least one thermal recording layer disposed on the support, wherein the layer comprises at least one electron-accepting compound, and microcapsules, which encapsulate an electron-donating dye precurser and are formed using a compound represented by the following general formula (I) and a compound represented by the following general formula (II):

Formula (I)

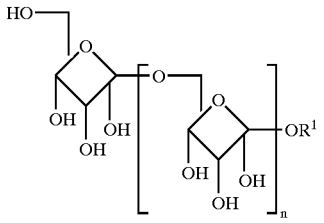

Formula (II)

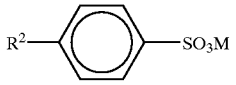

wherein each of $R^1$ and $R^2$ represents an alkyl group; n is an integer selected from 0 to 3; and M represents Na, Mg, K or Ca.

2. The thermal recording material according to claim 1, further comprising at least one thermal recording layer disposed on the support, the layer including at least microcapsules, which encapsulate a diazo compound, and a coupler, for reacting with the diazo compound to produce a color.

3. The thermal recording material according to claim 2, wherein a color density of the microcapsules at a recording energy of 100 mJ/mm$^2$ is no more than 0.20.

4. The thermal recording material according to claim 2, wherein the molar ratio of the surfactant (I) represented by the formula (I) [x] to the surfactant (II) represented by the formula (II) [y], x/y, is from 8/2 to 2/8.

5. The thermal recording material according to claim 1, wherein a color density of the microcapsules at a recording energy of 100 mJ/mm$^2$ is no more than 0.20.

6. The thermal recording material according to claim 1, wherein $R^1$ in formula (I) is an alkyl group having from 4 to 12 carbon atoms.

7. The thermal recording material according to claim 1, wherein $R^1$ in formula (I) is one of a t-octyl group and a n-octyl group.

8. The thermal recording material according to claim 1, wherein $R^2$ in formula (II) is an alkyl group having from 8 to 16 carbon atoms.

9. The thermal recording material according to claim 1, wherein $R^2$ in formula (II) is one of an n-dodecyl group and a t-dodecyl group.

10. The thermal recording material according to claim 1, wherein the reaction temperature for forming the microcapsules is from 60 to 70° C.

11. The thermal recording material according to claim 1, wherein the molar ratio of the surfactant (I) represented by the formula (I) [x] to the surfactant (II) represented by the formula (II) [y], x/y, is from 8/2 to 2/8.

12. A thermal recording material comprising a support and at least one thermal recording layer disposed on the support, wherein the layer comprises at least microcapsules, which encapsulate a diazo compound, and a coupler, for reacting with the diazo compound to produce a color, which microcapsules are formed using a compound represented by the following general formula (I) and a compound represented by the following general formula (II):

Formula (I)

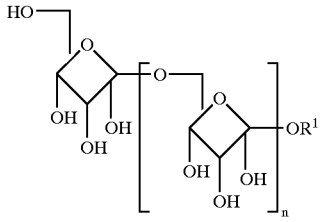

Formula (II)

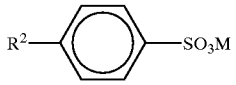

wherein each of $R^1$ and $R^2$ represents an alkyl group; n is an integer selected from 0 to 3; and M represents Na, Mg, K or Ca.

13. The thermal recording material according to claim 12, wherein a color density of the microcapsules at a recording energy of 100 mJ/mm$^2$ is no more than 0.20.

14. The thermal recording material according to claim 12, wherein $R^1$ in formula (I) is an alkyl group having from 4 to 12 carbon atoms.

15. The thermal recording material according to claim 12, wherein $R^1$ in formula (I) is one of a t-octyl group and a n-octyl group.

16. The thermal recording material according to claim 12, wherein $R^2$ in formula (II) is an alkyl group having from 8 to 16 carbon atoms.

17. The thermal recording material according to claim 12, wherein $R^2$ in formula (II) is one of an n-dodecyl group and a t-dodecyl group.

18. The thermal recording material according to claim 12, wherein the reaction temperature for forming the microcapsules is from 60 to 70° C.

19. The thermal recording material according to claim 12, wherein the molar ratio of the surfactant (I) represented by the formula (I) [x] to the surfactant (II) represented by the formula (II) [y], x/y, is from 8/2 to 2/8.

* * * * *